US011441093B2

(12) United States Patent
Nakagaki et al.

(10) Patent No.: US 11,441,093 B2
(45) Date of Patent: Sep. 13, 2022

(54) LUBRICATING OIL COMPOSITION AND LUBRICATING AGENT USING SAME

(71) Applicant: MORESCO CORPORATION, Kobe (JP)

(72) Inventors: Mao Nakagaki, Hyogo (JP); Shingo Maruyama, Hyogo (JP); Kohei Yamashita, Hyogo (JP)

(73) Assignee: MORESCO CORPORATION, Hyogo (JP)

( * ) Notice: Subject to any disclaimer, the term of this patent is extended or adjusted under 35 U.S.C. 154(b) by 0 days.

(21) Appl. No.: 17/046,524

(22) PCT Filed: Mar. 1, 2019

(86) PCT No.: PCT/JP2019/008040
§ 371 (c)(1),
(2) Date: Oct. 9, 2020

(87) PCT Pub. No.: WO2019/198377
PCT Pub. Date: Oct. 17, 2019

(65) Prior Publication Data

US 2021/0179959 A1 Jun. 17, 2021

(30) Foreign Application Priority Data

Apr. 13, 2018 (JP) ..... JP2018-077830

(51) Int. Cl.
*C10M 111/00* (2006.01)
*C10M 111/04* (2006.01)
(Continued)

(52) U.S. Cl.
CPC ..... *C10M 111/04* (2013.01); *C10M 105/36* (2013.01); *C10M 105/38* (2013.01);
(Continued)

(58) Field of Classification Search
CPC ..... C10M 111/04; C10M 105/36; C10M 105/38; C10M 107/50; C10M 137/02;
(Continued)

(56) References Cited

U.S. PATENT DOCUMENTS 4,449,415 A 5/1984 Groenhof
2010/0005830 A1 1/2010 Kaneko et al.
(Continued)

FOREIGN PATENT DOCUMENTS

CN 101525489 9/2009
CN 102994196 3/2013
(Continued)

OTHER PUBLICATIONS

International Search Report dated Jun. 4, 2019 in International (PCT) Application No. PCT/JP2019/008040.
(Continued)

*Primary Examiner* — Taiwo Oladapo
(74) *Attorney, Agent, or Firm* — Wenderoth, Lind & Ponack, L.L.P.

(57) ABSTRACT

An aspect of the present invention relates to a lubricant composition containing at least: (A) 50 to 80 mass % of silicone oil represented by formula (1) below, and having a mass-average molecular weight of 900 to 4000, a ratio (C/Si ratio) of carbon to silicon of 3.03 or higher in the structure, and a viscosity index (VI) of 300 or higher; (B) 10 to 49 mass % of hydrocarbon-based lubricant; and (C) 1 to 10 mass % of antioxidant.

18 Claims, 19 Drawing Sheets

MEASUREMENT RESULT OF SILICONE A-1 BY $^1$H-NMR

(51) Int. Cl.

| | |
|---|---|
| ***C10M 105/36*** | (2006.01) |
| ***C10M 105/38*** | (2006.01) |
| ***C10M 107/50*** | (2006.01) |
| ***C10M 137/02*** | (2006.01) |
| ***C10M 169/04*** | (2006.01) |
| ***C10M 173/00*** | (2006.01) |
| *C10N 50/00* | (2006.01) |
| *C10N 30/10* | (2006.01) |
| *C10N 40/02* | (2006.01) |
| *C10N 50/10* | (2006.01) |

(52) U.S. Cl.
CPC ..... *C10M 107/50* (2013.01); *C10M 137/02* (2013.01); *C10M 169/04* (2013.01); *C10M 173/00* (2013.01); *C10M 2207/2825* (2013.01); *C10M 2207/345* (2013.01); *C10M 2223/049* (2013.01); *C10M 2229/0445* (2013.01); *C10N 2030/10* (2013.01); *C10N 2040/02* (2013.01); *C10N 2050/01* (2020.05); *C10N 2050/10* (2013.01)

(58) Field of Classification Search
CPC ..... C10M 169/04; C10M 173/00; C10M 2207/2825; C10M 2207/345; C10M 2223/049; C10M 2229/0445; C10M 2209/084; C10M 2223/045; C10M 2207/026; C10M 2215/06; C10M 2207/04; C10M 2207/0406; C10M 2203/1025; C10M 2205/0285; C10M 2207/2835; C10M 2229/0425; C10M 2229/0415; C10N 2050/01; C10N 2030/10; C10N 2040/02; C10N 2050/10; C10N 2030/68; C10N 2030/06; C10N 2040/30; C10N 2030/02
See application file for complete search history.

(56) References Cited

U.S. PATENT DOCUMENTS

| | | | | |
|---|---|---|---|---|
| 2012/0004151 | A1* | 1/2012 | Aguilar | C10M 169/04 508/207 |
| 2015/0166927 | A1 | 6/2015 | Tamoto et al. | |
| 2015/0225327 | A1 | 8/2015 | Hayashi et al. | |
| 2015/0232782 | A1* | 8/2015 | Fisher | C10M 169/042 508/208 |
| 2015/0299609 | A1 | 10/2015 | Stammer et al. | |
| 2015/0315514 | A1 | 11/2015 | Stammer et al. | |
| 2017/0183598 | A1 | 6/2017 | Maruyama | |
| 2019/0085258 | A1 | 3/2019 | Hamachi | |
| 2019/0284494 | A1 | 9/2019 | Ballard et al. | |

FOREIGN PATENT DOCUMENTS

| | | |
|---|---|---|
| CN | 104395274 | 3/2015 |
| CN | 104487555 | 4/2015 |
| CN | 106661493 | 5/2017 |
| CN | 106795447 | 5/2017 |
| GB | 2506975 | 4/2014 |
| JP | 58-67793 | 4/1983 |
| JP | 61-264097 | 11/1986 |
| JP | 1-319590 | 12/1989 |
| JP | 5-247486 | 9/1993 |
| JP | 2002-69471 | 3/2002 |
| JP | 2003-261892 | 9/2003 |
| JP | 2012-207082 | 10/2012 |
| JP | 2015-525827 | 9/2015 |
| JP | 2015-172165 | 10/2015 |
| JP | 2015-537086 | 12/2015 |
| JP | 2016-500131 | 1/2016 |
| JP | 2017/155193 | 9/2017 |
| TW | 200923071 | 6/2009 |
| WO | 2008/041492 | 4/2008 |
| WO | 2017/193174 | 11/2017 |

OTHER PUBLICATIONS

Office Action issued in corresponding Taiwanese Application No. 108108385, with partial English translation.
Office Action dated Jan. 5, 2022 in corresponding Chinese Patent Application No. 201980025696.4, with English language translation.
Extended European Search Report dated Oct. 26, 2021 in corresponding European Patent Application No. 19785985.3.

* cited by examiner

MEASUREMENT RESULT OF SILICONE A-1 BY $^{1}$H-NMR

MEASUREMENT RESULT OF SILICONE A-2 BY $^{1}$H-NMR

MEASUREMENT RESULT OF SILICONE A-3 BY $^{1}$H-NMR

MEASUREMENT RESULT OF SILICONE A-4 BY $^{1}$H-NMR

MEASUREMENT RESULT OF SILICONE A-5 BY $^{1}$H-NMR

MEASUREMENT RESULT OF SILICONE A-6 BY $^{1}$H-NMR

MEASUREMENT RESULT OF SILICONE A-7 BY $^{1}$H-NMR

MEASUREMENT RESULT OF SILICONE A-8 BY $^{1}$H-NMR

MEASUREMENT RESULT OF SILICONE A-9 BY $^{1}$H-NMR

MEASUREMENT RESULT OF SILICONE A-10 BY $^{1}$H-NMR

MEASUREMENT RESULT OF SILICONE A-11 BY $^{1}$H-NMR

MEASUREMENT RESULT OF SILICONE A-12 BY $^{1}$H-NMR

MEASUREMENT RESULT OF SILICONE A-13 BY $^{1}$H-NMR

MEASUREMENT RESULT OF SILICONE A-14 BY $^{1}$H-NMR

MEASUREMENT RESULT OF SILICONE A-15 BY $^{1}$H-NMR

MEASUREMENT RESULT OF SILICONE A-16 BY $^{1}$H-NMR

MEASUREMENT RESULT OF SILICONE A-17 BY $^{1}$H-NMR

MEASUREMENT RESULT OF SILICONE A-18 BY $^{1}$H-NMR

MEASUREMENT RESULT OF SILICONE A-19 BY $^{29}$SI-NMR

LUBRICATING OIL COMPOSITION AND LUBRICATING AGENT USING SAME

TECHNICAL FIELD

The present invention relates to a lubricant composition containing silicone oil and a lubricating agent containing the same.

BACKGROUND ART

Lubricants and lubricant compositions are used in order to reduce friction and wear between movable parts and between movable surfaces of various mechanical devices.

Recently, development and compactness of mechanical devices have been advanced as the environment where transportation apparatuses are used is more expanded and harsher. Due to the expansion and the even more harshness of the environment where transportation apparatuses are used owing to the development and the compactness of mechanical devices, a lubricant having a high viscosity index (VI, i.e., having a small viscosity variation to a temperature change) and a wide usable temperature range has been demanded. Lubricant having a high VI is excellent in the energy saving performance (energy-saving) because of having a low viscosity at a low temperature and becoming small in the energy loss due to viscous resistance of the lubricant itself. Besides, lubricant having a high VI is unlikely to have an excessively low viscosity under a high temperature atmosphere compared with lubricant having a low VI, and can thus secure an oil film required for lubrication on a lubrication surface. Further, since the lubricant can retain an appropriate viscosity, a splatter of the lubricant can be suppressed to thereby prevent the lubricant from contaminating surroundings.

Conventionally, as means of raising the viscosity index of a hydrocarbon-based lubricant, a high molecular compound such as polymethacrylic acid ester and polybutene is generally used as a VI improver (see Patent Literatures 1 and 2).

In recent years, a lubricant composition has been proposed which contains a silicone oil (hereinafter, referred to as "Si oil") known as lubricant having a high VI as a lubricant base (see Patent Literatures 3 and 4).

However, a lubricant using the conventional VI improver disclosed in Patent Literature 1 has a problem of having a low resistance against a shear force, and of being incapable of maintaining the viscometric property at an initial period of use for a long period of time (i.e., of lowering the viscosity index). Besides, Patent Literature 2 indicates a possibility of increasing the shear stability by use of polymethacrylic acid ester having a specified structure. However, the problem still remains that an increase in the viscous resistance at a low temperature is inevitable due to the use of the high molecular compound, resulting in an inferior energy saving performance when used under a low temperature atmosphere.

On the other hand, the technology disclosed in Patent Literature 3 uses the silicone oil together with a mineral oil-based or an isomerized wax-based base oil aiming at achieving both the high VI and the lubricity. However, since dimethyl silicone having a poor compatibility with hydrocarbon-based lubricants is used as a silicone oil, a silicone oil having a high VI cannot be added in a large amount. Accordingly, it is necessary to use a conventional VI improver such as polymethacrylic acid ester and polybutene together with a silicone oil to secure a high VI. However, the problem still remains that although the additional amount of VI improver can be reduced compared with the conventional hydrocarbon-based lubricant, the viscosity increases at a low temperature, and viscometric property at an initial period of use cannot be maintained for a long period of time (i.e., the viscosity index lowers).

Besides, in the technology disclosed in Patent Literature 4, the high VI is maintained by using a silicone oil containing an aryl group having a high compatibility with the hydrocarbon-based lubricant to increase the additional amount of silicone oil. However, the lubricant composition added with a large amount of silicone oil containing an aryl group has a low lubricity and thus requires to increase the additional amount of ester oil as an opposite component to obtain a high lubricity. Thus, there is the problem that both the VI and the lubricity could not be satisfied.

An object of the present invention is to solve the aforementioned problems. Namely, the present invention is aimed at providing a lubricant composition that has both an excellent lubricity and a high viscosity index (VI), and can be used stably for a long period of time, and in a wide temperature range.

CITATION LIST

Patent Literature

Patent Literature 1: Japanese Patent Publication No. 2015-172165

Patent Literature 2 Japanese Patent Publication No. 2017-155193

Patent Literature 3: Japanese Patent Publication No. 2012-207082

Patent Literature 4: Japanese Patent Publication No. 2003-261892

SUMMARY OF INVENTION

The present inventors have made studies extensively to overcome the above-mentioned drawbacks, and as a result of the studies, the inventors have found that the above-mentioned object can be achieved by using a lubricant composition having a structure described below, and have completed the present invention by further making studies based on this finding.

Namely, a lubricant composition according to an aspect of the present invention contains, at least: (A) 50 to 80 mass % of silicone oil represented by a formula (1) below, and having a mass-average molecular weight of 900 to 4000, a ratio (C/Si ratio) of carbon to silicon of 3.03 or higher in the structure, and a viscosity index (VI) of 300 or higher; (B) 10 to 49 mass % of hydrocarbon-based lubricant; and (C) 1 to 10 mass % of antioxidant.

[Chemical formula1]

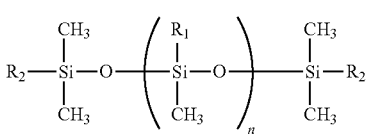

(1)

(In the formula (1), $R_1$ and $R_2$ represent an alkyl group or an aralkyl group with 1 to 12 carbons, and n represents an integer between 2 and 44.)

DESCRIPTION OF EMBODIMENTS

Figure 1:
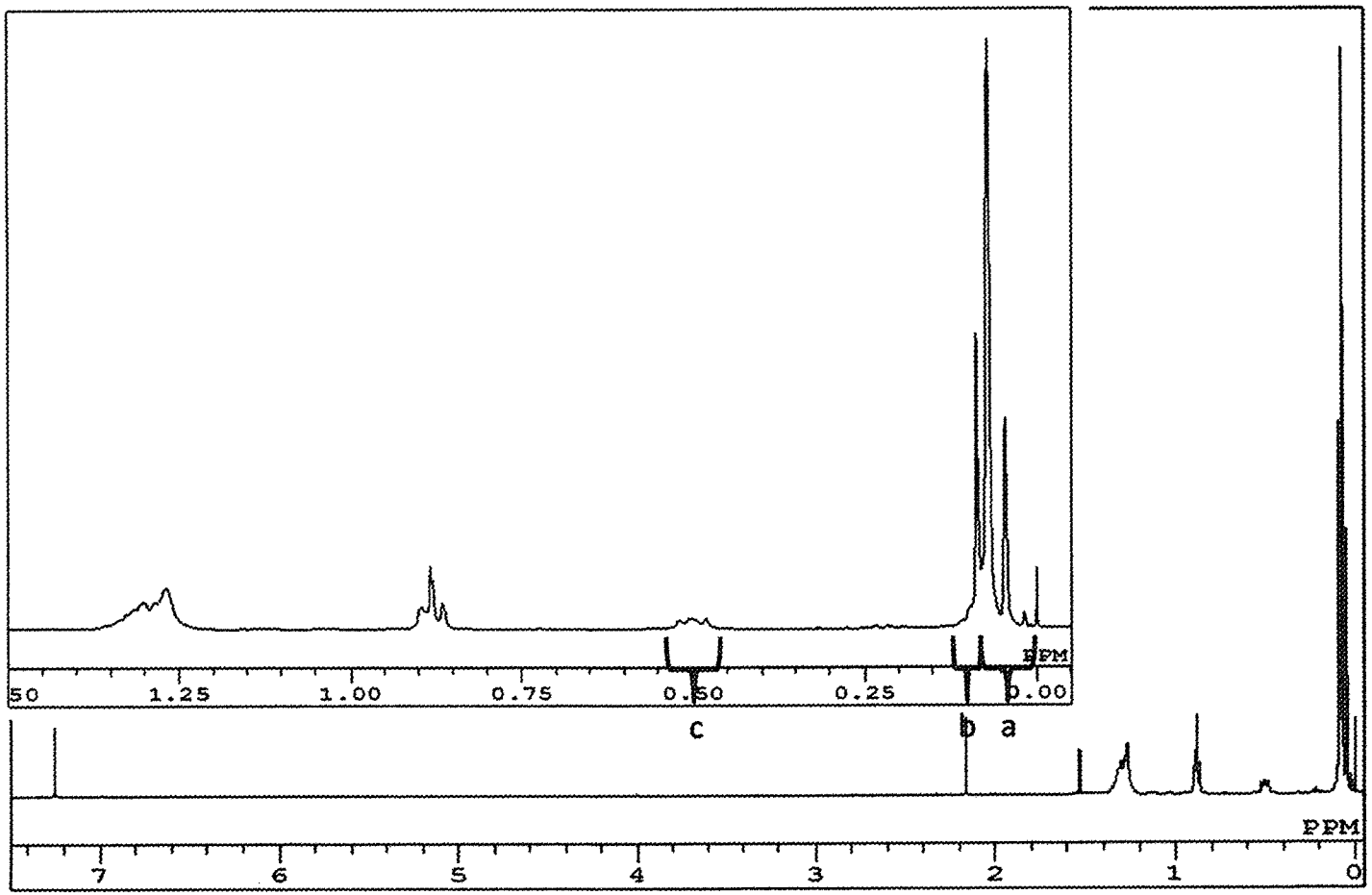
FIG. 1 shows an NMR data of Silicone A-1 synthesized in an embodiment.

As described above, a lubricant composition according to the present invention contains, at least: (A) 50 to 80 mass % of silicone oil represented by the formula (1) below, and having a mass-average molecular weight of 900 to 4000, a ratio (C/Si ratio) of carbon to silicon of 3.03 or higher in the structure, and a viscosity index (VI) of 300 or higher; (B) 10 to 49 mass % of hydrocarbon-based lubricant; and (C) 1 to 10 mass % of antioxidant.

[Chemical formula 2]

(1)

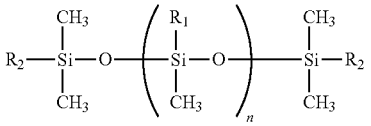

(In the formula (1), $R_1$ and $R_2$ represent an alkyl group or an aralkyl group with 1 to 12 carbons, and n represents an integer between 2 and 44.)

Owing to this structure, the lubricant composition can be stably used for a long period of time, and in a wide temperature range. More specifically, the lubricant composition according to the present embodiment has the following advantages:

of having a low viscosity, being hardly evaporated, and having a high energy saving performance;

of having a very excellent low temperature fluidity;

of having an excellent lubricity;

of having a small viscosity variation to a temperature change, and being capable of maintaining an oil film at a high temperature; and of having a good shear stability.

Hereinafter, the embodiments of the present invention will be described in detail. However, the present invention is not limited to these embodiments.

[(A) Silicone Oil]

The silicone oil contained in the lubricant composition according to the present embodiment is represented by the above formula (1), has a mass-average molecular weight of 900 to 4000, a ratio (C/Si ratio) of carbon to silicon of 3.03 or higher in the structure, and a viscosity index (VI) of 300 or higher.

In the formula (1), $R_1$ and $R_2$ represent an alkyl group or an aralkyl group with 1 to 12 carbons. $R_1$ and $R_2$ do not have a particularly limited structure, and may be linear, branched, or annular. Specifically, as example, an alkyl group (methyl, ethyl, propyl, isopropyl, butyl, octyl, nonyl, dodecyl); a cycloalkyl group (cyclohexyl, cycloheptyl); and an aralkyl group (benzyl, phenylethyl, isopropylphenyl) are included. One of these functional groups may be contained singly in the structure, or two or more groups thereof may be contained in the structure. Particularly, an alkyl group may be preferably contained.

The number of carbons contained in $R_1$ and $R_2$ is preferably 1 to 12, more preferably 1 to 10, and particularly preferably 1 to 8 from the viewpoint of maintaining a low viscosity at a low temperature. If the number of carbons contained in $R_1$ and $R_2$ is above 12, the property at a low temperature significantly deteriorates. Therefore, as a lubricant composition, it is difficult to be used in a low temperature range.

Additionally, in the formula (1), the letter n represents an integer between 2 and 44. If n is below 2, the mass-average molecular weight comes to be below 900. Therefore, as a lubricant composition, it has a low flash point, thereby limiting the use.

Further, the silicone oil in the embodiment has a ratio (C/Si ratio) of carbon to silicon of 3.03 or higher in the structure. C/Si ratio is more preferably 3.05 or higher from the viewpoint of further improving the compatibility with (B) hydrocarbon-based lubricant; and (C) antioxidant which will be described later.

In the embodiment, the aforementioned C/Si ratio is a value obtained by the following equation (1).

$$\text{C/Si ratio}=(n\times(\text{carbon number of } R_1+1)+\text{sum of carbon number of } R_2+4)\div(n+2) \quad \text{Equation (1)}$$

For example, in the case that the silicone oil has a structure represented by the formula (2) below, it is seen that:

$R_1$=C3($n_1$=6) and C1($n_2$=4); and $R_2$=C1.

Therefore, C/Si ratio is 3.16.

[Chemical Formula 3]

(2)

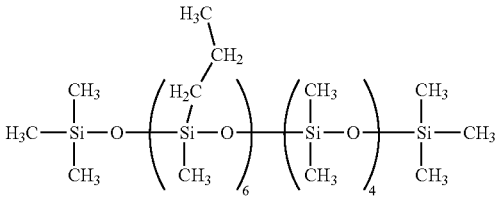

Further, for example, in the case that the silicone oil has a structure represented by the formula (3) below, it is seen that:

$R_1$=C2;

n=10; and $R_2$=C1.

Therefore, C/Si ratio is 3.00.

[Chemical formula 4]

(3)

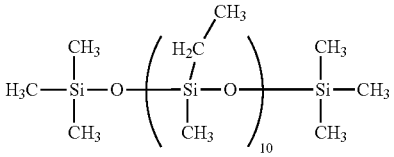

For example, in the case that the silicone oil has a structure represented by the formula (4) below, it is seen that:

$R_1$=C8($n_1$=5) and C1($n_2$=10); and $R_2$=C1.

Therefore, C/Si ratio is 4.18.

[Chemical formula 5]

(4)

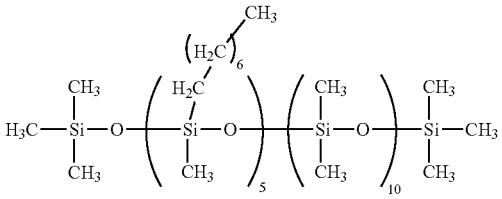

Further, for example, in the case that the silicone oil has a structure represented by the formula (5) below, it is seen that:

$R_1$=C6($n_1$=3), C9($n_2$=2), and C1($n_3$=11); and $R_2$=C1.

Therefore, C/Si ratio is 3.83.

[Chemical formula 6]

(5)

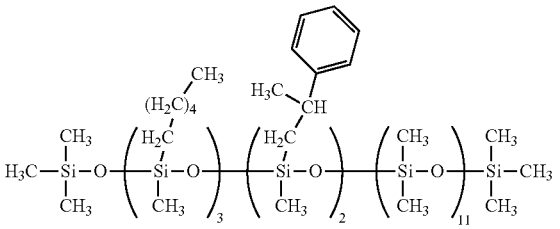

For example, in the case that the silicone oil has a structure represented by the formula (6) below, it is seen that:

$R_1$=C8($n_1$=5) and C1 ($n_2$=10); and $R_2$=C1 and C8.

Therefore, C/Si ratio is 4.59.

[Chemical formula 7]

(6)

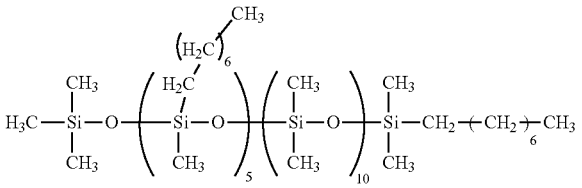

For example, in the case that the silicone oil has a structure represented by the formula (7) below, it is seen that, in the alkyl group:

$R_1$=C1;

n=9; and $R_2$=C12.

Therefore, C/Si ratio is 4.18.

[Chemical formula 8]

(7)

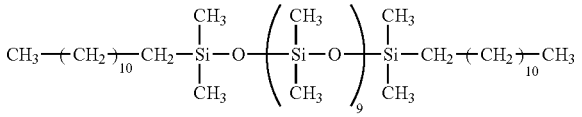

If the aforementioned C/Si ratio is below 3.03, the silicone oil has a poor compatibility with a hydrocarbon-based lubricant that is the component (B). Therefore, there is a problem of failing to exhibit a stable performance as a lubricant composition. On the other hand, although an upper limit value of the aforementioned C/Si ratio is not particularly limited, C/Si ratio is preferably 9.0 or lower in view of that an excessively high C/Si ratio lowers the viscosity index.

Specifically, for example, methylhexylpolysiloxane, methyloctylpolysiloxane, and the like are included as a silicone oil having the aforementioned structure.

The mass-average molecular weight of the silicone oil in the embodiment is 900 to 4000. If the mass-average molecular weight is below 900, the flash point of the silicone oil comes to be below 200° C., and results in a limited use for a lubricant composition. Further, if the mass-average molecular weight is above 4000, the kinematic viscosity at 40° C. comes to be above 200 $mm^2/s$, and results in a lubricant composition having a high viscosity, and an inferior energy saving performance.

It should be noted that the mass-average molecular weight of the silicone oil in the embodiment is a value measured by $^1$H-NMR or $^{29}$Si—NMR as shown in examples described below. Hereinafter, the mass-average molecular weight is simply referred to as "average molecular weight".

In the embodiment, the viscosity index (VI) of the silicone oil is determined to be 300 or higher to obtain a lubricant composition having a high VI. The VI is further preferably 350 or higher, and particularly preferably 400 or higher. In the present specification, the VI is a value measured and calculated in accordance with JIS K 2283 (2000).

As (A) the silicone oil in the embodiment, one of the silicone oils mentioned above may be singly used, or a plurality of the aforementioned silicone oils may be used in combination.

A method for synthesizing the silicone oil mentioned above is not limited to a particular one. However, for example, a lowly polymerized polysiloxane containing a SiH group can be obtained by making a linear polysiloxane containing a SiH group in the molecular structure and a low polymerized polysiloxane such as hexamethyldisiloxane undergo an equilibrating reaction in the presence of an acid catalyst such as an activated clay. Otherwise, a methyloctylpolysiloxane can be obtained by making polysiloxane containing a SiH group under a nitrogen atmosphere undergo an addition reaction to an olefin compound such as 1-octene in the presence of hydrosilylation catalyst.

In the lubricant composition in the embodiment, the content of (A) the silicone oil to the entire composition is 50 to 80 mass % from the viewpoint of the viscosity index and the lubricity. Particularly, the content of the silicone oil is preferably 55 to 80 mass %, and further preferably 65 to 75 mass %. If the content of the component (A) is less than 50 mass %, the resultant lubricant composition has a poor effect to the improvement of the viscosity index. If the content of the component (A) is more than 80 mass %, the lubricity decreases, and thus is not recommendable.

[(B) Hydrocarbon-Based Lubricant]

The lubricant composition in the embodiment includes hydrocarbon-based lubricant. The hydrocarbon-based lubricant to be used is not limited to a particular one as long as it is compatible with the aforementioned (A) silicone oil. Specifically, for example, an ester oil, an ether oil, a poly-α-olefin (PAO) oil, and a mineral oil are included.

As the ester oil, specifically, ester of monohydric alcohols or polyhydric alcohols with monobasic acid or polybasic acid is included.

As the aforementioned monohydric alcohols or polyhydric alcohols, there are monohydric alcohols or polyhydric alcohols containing a hydrocarbon group with 1 to 30 carbons, preferably 4 to 20 carbons, further preferably 6 to 18 carbons. As the aforementioned polyhydric alcohols, specifically, there are trimethylolpropane, pentaerythritol, dipentaerythritol, and the like.

Besides, as the aforementioned monobasic acid or polybasic acid, there are monobasic acids or polybasic acids containing a hydrocarbon group with 1 to 30 carbons, preferably 4 to 20 carbons, further preferably 6 to 18 carbons.

The hydrocarbon group referred herein may be linear or branched. For example, there are the hydrocarbon groups such as alkyl group, alkenyl group, cycloalkyl group, alkylcycloalkyl group, aryl group, alkylaryl group, arylalkyl group.

In the embodiment, when an ester oil is used as the component (B), one of the ester oils mentioned above may be singly used, or two or more ester oils may be used in combination.

In a preferred example, dibasic acid ester or polyhydric alcohol fatty acid ester having a flash point of 200° C. or higher and a pour point of −40° C. or lower may be used as an ester oil. Specifically, polyhydric alcohol fatty acid ester such as fatty acid ester of trimethylolpropane or fatty acid ester of pentaerythritol is further preferable from the viewpoint of having a low evaporativity.

As the ether oil, specifically, there are polyoxy ether, dialkyl ether, and aromatic ether.

Further, as the poly-α-olefin oil, a polymer of an α-olefin with 2 to 15 carbons or a hydride thereof such as polybutene, 1-octene oligomer, 1-decene oligomer are included.

As the mineral oil, an atmospheric residue obtained by atmospherically distilling a paraffin-based, a naphthene-based, or an intermediary crude oil; a distillate obtained by vacuum distilling the atmospheric residue; a mineral oil obtained by refining the distillate by performing one or more processes among solvent deasphalting, solvent extraction, hydrocracking, solvent dewaxing, catalytic dewaxing, and hydrorefining, such as light neutral oil, medium neutral oil, heavy neutral oil, bright stock; and a mineral oil obtained by isomerizing a wax (GTL Wax (Gas To Liquid WAX)) produced by a process such as Fischer-Tropsch process are included.

In the embodiment, one of the aforementioned hydrocarbon-based lubricants may be used singly, or two or more may be used in combination as the component (B).

The content of (B) hydrocarbon-based lubricant in the lubricant composition in the present embodiment is 10 to 49 mass % to the total amount of the composition from the viewpoint of the lubricity and the viscosity index. Its content is further preferably 15 to 40 mass %, and further, particularly preferably 15 to 25 mass %. If the content of the hydrocarbon-based lubricant is less than 10 mass %, it is difficult to obtain a sufficient lubricity. If its content is more than 49 mass %, the content of the silicone oil in the lubricant composition is too small and the viscosity index in the lubricant composition lowers, and thus is not preferable.

Further, the lubricant composition in the embodiment is further improved in lubricity of the lubricant composition when containing 10 mass % or more of ester oil as the (B) hydrocarbon-based lubricant. Namely, as a preferred example, the lubricant composition preferably includes 10 to 49 mass % of ester oil as the (B) hydrocarbon-based lubricant.

[(C) Antioxidant]

As antioxidant for the component (C) of the embodiment, antioxidant generally used for lubricant may be used without a particular limitation. As an example, a phenol-based compound, an amine-based compound, a phosphorus-based compound, and a sulfur-based compound are included.

More specifically, as examples, an alkylphenol group such as 2, 6-di-tert-butyl-4-methylphenol, a bisphenol group such as methylene-4, 4-bisphenol (2, 6-di-tert-butyl-4-methylphenol), a naphtylamine group such as phenyl-α-naphtylamine, a dialkyl diphenylamine group, a phosphite group, ditridecyl-3, 3'-thiodipropionate group are included.

In the lubricant composition in the embodiment, the content of the aforementioned (C) antioxidant to the total amount of the composition is set to be 1 to 10 mass % from the viewpoint of inhibiting the oxidization and reducing the evaporating amount. Its content is preferably 3 to 7 mass %, and further, particularly preferably 5 mass %.

If the content of the component (C) is less than 1 mass %, the resultant lubricant composition hardly accomplishes the effect of reducing the evaporating amount. If the content is more than 10 mass %, it is not preferable because the evaporating amount of the lubricant composition increases due to the evaporation of the antioxidant itself, and the viscosity index of the lubricant composition lowers.

As the component (C), 1.0 to 10.0 mass % of phosphite is preferably contained from the viewpoint of a further improvement in the lubricity. Namely, in the embodiment, the lubricant composition of the embodiment preferably contains 1.0 to 10.0 mass % of phosphite as the (C) antioxidant. The content of phosphite as the (C) antioxidant is further preferably 2.5 to 7.0 mass %, and particularly preferably 2.5 to 5.0 mass %.

In the (C) antioxidant, if containing less than 1 mass % of phosphite, the resultant lubricant composition may hardly accomplish the effect of improving the lubricity. If the content of phosphite is more than 10 mass %, in some cases it is not preferable because the evaporating amount of the lubricant composition increases due to the evaporation of the phosphite itself, and the viscosity index of the lubricant composition lowers.

[Other Additives]

For the purpose of further improving its performance, or in order to attribute further performance depending on the necessity, various types of additives such as a metal deactivator, an anti-foaming agent, a thickening agent, and a colorant may be added to the lubricant composition in the embodiment singly, or a plurality of additives may be mixed in combination as long as it does not impair the advantageous effect of the present invention.

As the metal deactivator, for example, benzotriazole-based, tolyltriazole-based, thiadiazole-based, and imidazole-based compounds are included.

As the anti-foaming agent, for example, polysiloxane, polyacrylate, and styrene ester polymer are included.

As the thickening agent, for example, a metallic soap (i.e., lithium soap), silica, expanded graphite, polyurea, and clay (for example, hectorite or bentonite) are included.

When the aforementioned additives are added to the lubricant composition in the embodiment, the amount to be added may be substantially 0.0 to 10.0 mass %, or 0.1 to 5 mass % to the entirety of the lubricating agent composition (total mass). A thickening agent for forming a grease including the lubricant composition of the embodiment may be used in the amount of 5 to 25 mass % to the entire lubricating agent grease composition (total mass).

(Preparation Method)

A method for preparing the lubricant composition of the embodiment is not limited to a particular one. For example, the lubricant composition may be prepared by heating (A) silicone oil, (B) hydrocarbon-based oil, (C) antioxidant, and the other additives to 100° C. and mixing the components.

The lubricant composition of the embodiment obtained in the aforementioned manner preferably has an absolute viscosity of 5.0 Pa·s or lower at −40° C. This structure attributes an advantage of enhancing the energy serving performance when used under a low temperature atmosphere.

Further, in the lubricant composition, the viscosity index (VI) is preferably 200 or higher, and further preferably 250 or higher. This structure prevents the lubricant composition from having an excessively low viscosity under a high temperature atmosphere. Therefore, an oil film required for lubrication can be secured on a lubrication surface. Further, the lubricant retains an appropriate viscosity. Therefore, the lubricant composition has an advantage of suppressing a splatter thereof, thereby preventing the contamination of the surroundings.

(Use)

Since the lubricant composition of the present embodiment can be stably used in a wide temperature range for a long period of time, it can be used as various types of lubricant. For example, it can be suitably used as a lubricant for bearing, a lubricant for impregnated bearing, a grease base oil, a freezer oil, and a plasticizer.

The present specification discloses the technologies in various modes as described above. Among them, the principal technologies are summarized hereinbelow.

A lubricant composition according to an aspect of the present invention contains, at least: (A) 50 to 80 mass % of silicone oil represented by the formula (1) above, and having a mass-average molecular weight of 900 to 4000, a ratio (C/Si ratio) of carbon to silicon of 3.03 or higher in the structure, and a viscosity index (VI) of 300 or higher; (B) 10 to 49 mass % of hydrocarbon-based lubricant; and (C) 1 to 10 mass % of antioxidant.

Owing to the aforementioned structure, it is possible to provide a lubricant composition that has both an excellent lubricity and a high viscosity index (VI), and thus can be stably used for a long period of time, and in a wide temperature range.

Further, the lubricant composition preferably contains 10 to 49 mass % of ester oil as the (B) hydrocarbon-based lubricant. This allows the composition to obtain a further excellent lubricity.

Further, the lubricant composition preferably contains 1 to 10 mass % of phosphite as the (C) antioxidant. This allows the composition to obtain a further excellent lubricity.

Further, the lubricant composition preferably has an absolute viscosity of 5.0 Pa·s or lower at −40° C. This allows the composition to further securely obtain the effects described above.

Further, in the lubricant composition the viscosity index (VI) is preferably 250 or higher. This allows the composition to further securely obtain the effects described above.

A lubricating agent according to another aspect of the present invention includes the lubricant composition described above.

Further, the present invention covers a grease and an emulsion including the aforementioned lubricant composition and lubricating agent, a lubricating method using the same, and an application of the aforementioned lubricant composition and lubricating agent to a bearing.

EXAMPLES

Hereinafter, Examples of the present invention will be described. However, the present invention is not limited to them.

First, materials used in the Examples will be specified below.

(Silicone Oil)

Silicone oils A-1 to A-19 will be described later.

(Hydrocarbon-Based Lubricant)

Ester oil B-1: pentaerythritol fatty acid ester produced by NOF Corporation, Product Name: Unister HR-32 (kinematic viscosity at 40° C.: 33.5 $mm^2/s$, kinematic viscosity at 100° C.: 5.8 $mm^2/s$, VI: 115, flash point: 274° C., pour point: −50° C.)

Ester oil B-2: trimethylolpropane fatty acid ester (C6 to C12) produced by NOF Corporation, Product Name: Unister H-334R (kinematic viscosity at 40° C.: 19.6 $mm^2/s$, kinematic viscosity at 100° C.: 4.4 $mm^2/s$, VI: 138, and pour point: −40° C.)

Ester oil B-3: dioctyl sebacate produced by NOF Corporation, Product Name: Unister DOS (kinematic viscosity at 40° C.: 11.7 $mm^2/s$, kinematic viscosity at 100° C.: 3.2 $mm^2/s$, VI: 151, flash point: 230° C., pour point: −60° C.)

Ether oil B-4: alkyl diphenyl ether 1 produced by MORESCO Corporation (kinematic viscosity at 40° C.: 102.6 $mm^2/s$, kinematic viscosity at 100° C.: 12.6 $mm^2/s$, VI: 117)

PAO oil B-5: poly-α-olefin produced by Exxon Mobil Corporation, Product Name: SpectraSyn 10 (kinematic viscosity at 40° C.: 66.0 $mm^2/s$, kinematic viscosity at 100° C.: 10.0 $mm^2/s$, VI: 136)

Mineral oil B-6: mineral oil produced by COSMO OIL LUBRICANTS Co., Ltd., Product Name: COSMO PURE SPIN TK (kinematic viscosity at 40° C.: 9.3 $mm^2/s$, kinematic viscosity at 100° C.: 2.5 $mm^2/s$, VI: 94)

Ether oil B-7: alkyl diphenyl ether 2 produced by MORESCO Corporation (kinematic viscosity at 40° C.: 70.0 $mm^2/s$, kinematic viscosity at 100° C.: 9.3 $mm^2/s$, VI: 110)

PAO oil B-8: poly-α-olefin produced by Exxon Mobil Corporation, Product Name: SpectraSyn Elite 65 (kinematic viscosity at 40° C.: 614.0 $mm^2/s$, kinematic viscosity at 100° C.: 65.0 $mm^2/s$, VI: 179)

(Antioxidant)

Antioxidant C-1: aromatic amine-based compound produced by BASF SE, Product Name: IRGANOX L-57

Antioxidant C-2: phenol-based compound produced by BASF SE, Product Name: IRGANOX L-135

Antioxidant C-3: sulfur-based compound produced by ADEKA Corporation, Product Name: ADEKA STAB AO-503

Antioxidant C-4: phosphite-based compound produced by Johoku Chemical Co., Ltd., Product Name: JP-333E Antioxidant C-5: phosphite-based compound produced by Johoku Chemical Co., Ltd, Product Name: JPE-13R Antioxidant C-6: phosphite-based compound produced by Johoku Chemical Co., Ltd, Product Name: JP-308E Antioxidant C-7: phosphite-based compound produced by Johoku Chemical Co., Ltd, Product Name: JP-318-O Antioxidant C-8: aromatic amine-based compound produced by Chemtura Corporation, Product Name: Naugalube APAN (Others)

Metal deactivator: benzotriazole-based compound produced by Vanderbilt Chemicals, LLC, Product Name: CUVAN303

Extreme pressure agent: zinc dialkylthiophosphate produced by ADEKA Corporation, Product Name: ADEKA KIKU-LUBE Z-112

Viscosity Index improver: acrylic polymer produced by Evonik Industries AG, Product Name: VISCOPLEX 8-702

[Synthesis of Silicone Oil]

(Synthesis Example 1: Silicone A-1)

148 g of methylhydrogenpolysiloxane (Product Name: KF-99) produced by Shin-Etsu Chemical Co., Ltd., 671 g of decamethylcyclopentasiloxane (Product Name: KF-995) produced by Shin-Etsu Chemical Co., Ltd., 182 g of hexamethyldisiloxane (Product Name: KF-96L-0.65CS) produced by Shin-Etsu Chemical Co., and 5 g of activated clay were put in a 2-liter separable flask, and stirred at 90° C. for 4 hours. The activated clay was removed by filtration after the solution was cooled to a room temperature.

Subsequently, the filtrate was put in a 2-liter four-necked flask, and was heated and decompressed to remove silicone compounds having a low molecular weight. As a result, 641 g of dimethylsiloxane-methylhydrogensiloxane copolymer (Silicone A) having both molecular chain ends blocked with trimethylsiloxy group was obtained. The obtained Silicone A was brought into reaction with an excessive amount of aqueous solution of sodium hydroxide and n-butanol, and a generation amount of hydrogen gas was measured. The generation amount of hydrogen gas was 55 mL/g. An amount of hydrogen derived from hydrosilyl group in Silicone A, which was calculated from the obtained amount of hydrogen gas, was seen to be 0.25 mass %.

144 g of Silicone A was put in a 500-mililiter four-necked flask, and 187 g (i.e., 2.22 mol) of 1-hexene (Product Name: LINEALENE 6) produced by Idemitsu Kosan Co., Ltd. and 70 μL (converted in Pt: 13 ppm) of Pt-CTS-toluene solution, which is a platinum catalyst, produced by N. E. CHEMCAT Corporation were put on a dropping funnel to undergo a nitrogen substitution. Silicone A was heated, and dropping of the mixture of 1-hexene and the platinum catalyst was started when the liquid temperature reached 60° C. At this moment, the dropping speed was regulated so as to keep the liquid temperature between 80° C. and 110° C. After all the mixture of 1-hexene and the platinum catalyst were dropped, the reactants were developed at 90° C. for 20 hours. After having been developed, the disappearance of the peak in SiH groups was confirmed by use of $^1$H-NMR. Subsequently, the resultant was heated and decompressed to remove an excessive amount of 1-hexene from the reactants. As a result, 189 g of dimethylsiloxane-methylhexylsiloxane copolymer (Silicone A-1) having both molecular chain ends blocked with trimethylsiloxy group was obtained.

As a result of analysis on the obtained Silicone A-1 by use of $^1$H-NMR, it was found that: the average molecular weight was 1377; the average number of units ($n_1$) having an organic group $R_1$ (C6) was 2.8; the average number of units ($n_2$) having an organic group $R_1'$ (C1) was 10.9; and the ratio C/Si in the molecular structure was 3.03.

The NMR data of Silicone A-1 is shown in FIG. 1.

The $^1$H-NMR analysis on dimethylsiloxane-methylalkylsiloxane copolymer having both molecular chain ends blocked with trimethylsiloxy group shown in A-1 to A-12 was executed in the following manner.

At a (chemical shift: 0.01 to 0.08 ppm) is denoted a peak of hydrogen derived from a methyl group in a dimethyl unit and a unit having an organic group R.

At b (chemical shift: 0.08 to 0.10 ppm) is denoted a peak of hydrogen derived from a methyl group in trimethylsiloxy group at both molecular chain ends.

At c (chemical shift: 0.40 to 0.60 ppm) is denoted a peak of hydrogen derived from $CH_2$ adjacent to silicon in an organic group R.

The average molecular weight, the average number of units having an organic group R, and the average number of dimethyl units were calculated by the following equations (2) on the basis of the integrated value (ratio) of the peaks of the a, b, and c.

$$\text{Average number of dimethyl units}=((a-1.5\times c))\div 6\times 18\div b$$

$$\text{Average number of units having an organic group R}=c\div 2\times 18\div b$$

Average molecular weight=Average number of units having an organic group R=Molecular weight of a unit having an organic group R+Average number of dimethyl units×Molecular weight of a dimethyl unit+Molecular weight of a trimethylsiloxy group at both molecular chain ends Equations (2)

$^1$H-NMR (solvent: deuterated chloroform, primary standard substance: TMS)

When the integrated value at δ=0.40 to 0.60 ppm is 10.0, the integrated value at δ=0.01 to 0.08 ppm is 130.3, and the integrated value at δ=0.08 to 0.10 ppm is 31.8.

(Synthesis Example 2: Silicone A-2)

306 g of methylhydrogenpolysiloxane (Product Name: KF-99) produced by Shin-Etsu Chemical Co., Ltd., 1306 g of decamethylcyclopentasiloxane (Product Name: KF-995) produced by Shin-Etsu Chemical Co., Ltd., 357 g of hexamethyldisiloxane (Product Name: KF-96L-0.65CS) produced by Shin-Etsu Chemical Co. Ltd., and 11 g of activated clay were put in a 2-liter separable flask, and stirred at 90° C. for 6 hours. The activated clay was removed by filtration after the solution was cooled to a room temperature.

Subsequently, the filtrate was put in a 2-liter four-necked flask, and was heated and decompressed to remove silicone compounds having a low molecular weight. As a result, 1221 g of dimethylsiloxane-methylhydrogensiloxane copolymer (Silicone B) having both molecular chain ends blocked with trimethylsiloxy group was obtained. The obtained Silicone B was brought into reaction with an excessive amount of aqueous solution of sodium hydroxide and n-butanol, and a generation amount of hydrogen gas was measured. The generation amount of hydrogen gas was 58 mL/g. An amount of hydrogen derived from hydrosilyl group in Silicon B, which was calculated from the obtained amount of hydrogen gas, was seen to be 0.26 mass %.

124 g of Silicone B was put in a 500-mililiter four-necked flask, and 147 g (i.e., 1.74 mol) of 1-hexene (Product Name: LINEALENE 6) produced by Idemitsu Kosan Co., Ltd. and 140 μL (converted in Pt: 29 ppm) of Pt-CTS-toluene solution, which is a platinum catalyst, produced by N. E. CHEMCAT Corporation were put on a dropping funnel to undergo a nitrogen substitution. Silicone B was heated, and dropping of the mixture of 1-hexene and the platinum catalyst was started when the liquid temperature reached 60° C. At this moment, the dropping speed was regulated so as to keep the liquid temperature between 80° C. and 110° C. After all the mixture of 1-hexene and the platinum catalyst were dropped, the reactants were developed at 90° C. for 20 hours. After having been developed, the disappearance of the peak in SIR groups was confirmed by use of $^1$H-NMR. Subsequently, the resultant was heated and decompressed to remove an excessive amount of 1-hexene from the reactants. As a result, 163 g of dimethylsiloxane-methylhexylsiloxane copolymer (Silicone A-2) having both molecular chain ends blocked with trimethylsiloxy group was obtained.

As a result of analysis on the obtained Silicone A-2 by use of $^1$H-NMR, it was found that: the average molecular weight was 1361; the average number of units ($n_t$) having an organic group $R_1$ (C6) was 2.9; the average number of units ($n_2$) having an organic group $R_1'$ (C1) was 10.6; and the ratio C/Si in the molecular structure was 3.05.

Figure 2:
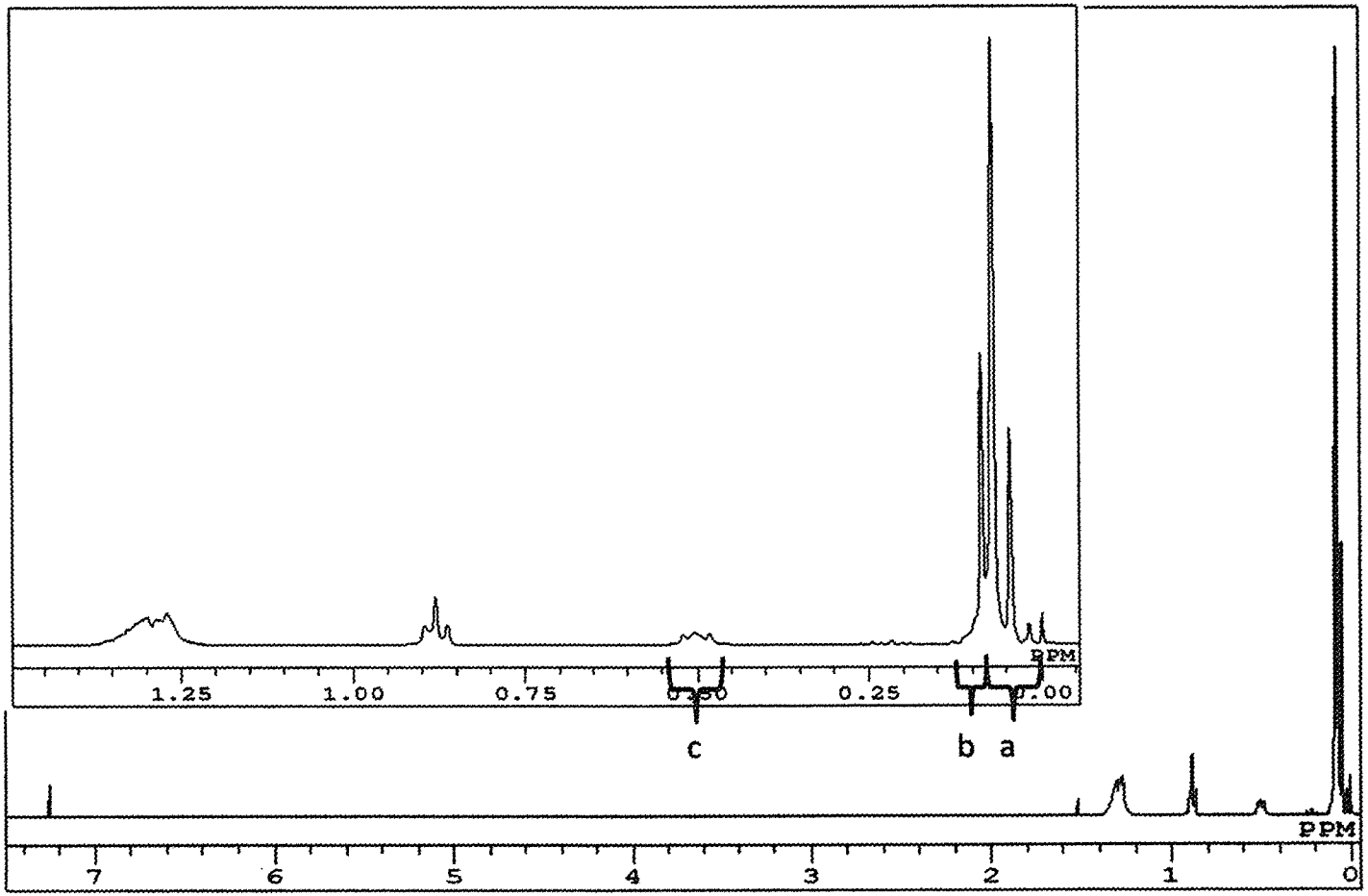
FIG. 2 shows an NMR data of Silicone A-2 synthesized in the embodiment.

The NMR data of Silicone A-2 is shown in FIG. 2.

$^1$H-NMR (solvent: deuterated chloroform, primary standard substance: TMS)

When the integrated value at δ=0.40 to 0.60 ppm is 10.0, the integrated value at δ=0.01 to 0.08 ppm is 126.3, and the integrated value at δ=0.08 to 0.10 ppm is 31.5.

(Synthesis Example 3: Silicone A-3)

1125 g of methylhydrogenpolysiloxane (Product Name: KF-99) produced by Shin-Etsu Chemical Co., Ltd., 2866 g of decamethylcyclopentasiloxane (Product Name: KF-995) produced by Shin-Etsu Chemical Co., Ltd., 874 g of hexamethyldisiloxane (Product Name: KF-96L-0.65CS) produced by Shin-Etsu Chemical Co. Ltd., and 56 g of activated clay were put in a 10-liter separable flask, and stirred at 90° C. for 4 hours. The activated clay was removed by filtration after the solution was cooled to a room temperature.

Subsequently, the filtrate was put in a 10-liter four-necked flask, and was heated and decompressed to remove silicone compounds having a low molecular weight. As a result, 3016 g of dimethylsiloxane-methylhydrogensiloxane copolymer (Silicone C) having both molecular chain ends blocked with trimethylsiloxy group was obtained. The obtained Silicone C was brought into reaction with an excessive amount of aqueous solution of sodium hydroxide and n-butanol, and a generation amount of hydrogen gas was measured. The generation amount of hydrogen gas was 86 mL/g. An amount of hydrogen derived from hydrosilyl group in Silicone C, which was calculated from the obtained amount of hydrogen gas, was seen to be 0.39 mass %.

150 g of Silicone C was put in a 500-mililiter four-necked flask, and 59 g (i.e., 0.70 mol) of 1-hexene (Product Name: LINEALENE 6) produced by Idemitsu Kosan Co., Ltd. and 16 μL (converted in Pt: 3 ppm) of Pt-CTS-toluene solution, which is a platinum catalyst, produced by N. E. CHEMCAT Corporation were put on a dropping funnel to undergo a nitrogen substitution. Silicone C was heated, and dropping of the mixture of 1-hexene and the platinum catalyst was started when the liquid temperature reached 60° C. At this moment, the dropping speed was regulated so as to keep the liquid temperature between 80° C. and 110° C. After all the mixture of 1-hexene and the platinum catalyst were dropped, the reactants were developed at 90° C. for 2 hours. After having been developed, the disappearance of the peak in SiH groups was confirmed by use of $^1$H-NMR. Subsequently, the resultant was heated and decompressed to remove an excessive amount of 1-hexene from the reactants. As a result, 190 g of dimethylsiloxane-methylhexylsiloxane copolymer (Silicone A-3) having both molecular chain ends blocked with trimethylsiloxy group was obtained.

As a result of analysis on the obtained Silicone A-3 by use of $^1$H-NMR, it was found that: the average molecular weight was 1469; the average number of units ($n_1$) having an organic group $R_1$ (C6) was 4.2; the average number of units ($n_2$) having an organic group $R_1'$ (C1) was 9.4; and the ratio C/Si in the molecular structure was 3.47.

Figure 3:
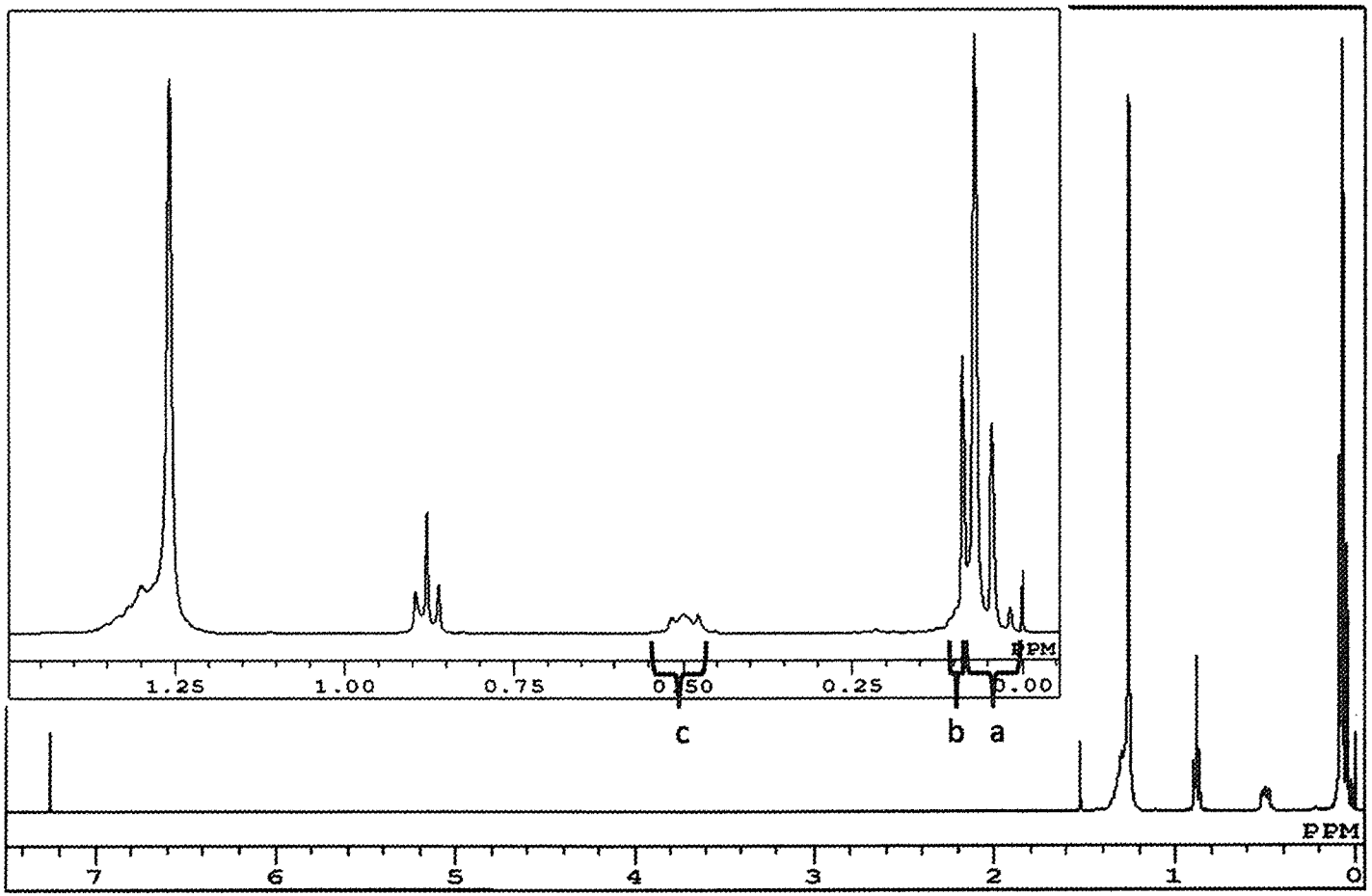
FIG. 3 shows an NMR data of Silicone A-3 synthesized in the embodiment.

The NMR data of Silicone A-3 is shown in FIG. 3.

$^1$H-NMR (solvent: deuterated chloroform, primary standard substance: TMS)

When the integrated value at δ=0.40 to 0.60 ppm is 10.0, the integrated value at δ=0.01 to 0.08 ppm is 82.3, and the integrated value at δ=0.08 to 0.10 ppm is 21.4.

(Synthesis Example 4: Silicone A-4)

2319 g (i.e., 2.16 mol) of Silicone C obtained in Synthesis Example 3 was put in a 5-liter four-necked flask, and 1221 g (i.e., 10.88 mol) of 1-octene (Product Name: LINEALENE 8) produced by Idemitsu Kosan Co., Ltd. and 0.3 mL (converted in Pt: 4 ppm) of Pt-CTS-toluene solution, which is a platinum catalyst, produced by N. E. CHEMCAT Corporation were put on a dropping funnel to undergo a nitrogen substitution. Silicone C was heated, and dropping of the mixture of 1-octene and the platinum catalyst was started when the liquid temperature reached 60° C. At this moment, the dropping speed was regulated so as to keep the liquid temperature between 80° C. and 110° C. After all the mixture of 1-octene and the platinum catalyst were dropped, the reactants were developed at 100° C. for 2 hours. After having been developed, the disappearance of the peak in SIR groups was confirmed by use of $^1$H-NMR. Subsequently, the resultant was heated and decompressed to remove an excessive amount of 1-octene from the reactants. As a result, 3251 g of dimethylsiloxane-methyloctylsiloxane copolymer (Silicone A-4) having both molecular chain ends blocked with trimethylsiloxy group was obtained.

As a result of analysis on the obtained Silicone A-4 by use of $^1$H-I-NMR, it was found that: the average molecular weight was 1741; the average number of units ($n_1$) having an organic group $R_1$ (C8) was 4.7; the average number of units ($n_2$) having an organic group $R_1$ '(C1) was 10.3; and the ratio C/Si in the molecular structure was 4.05.

Figure 4:
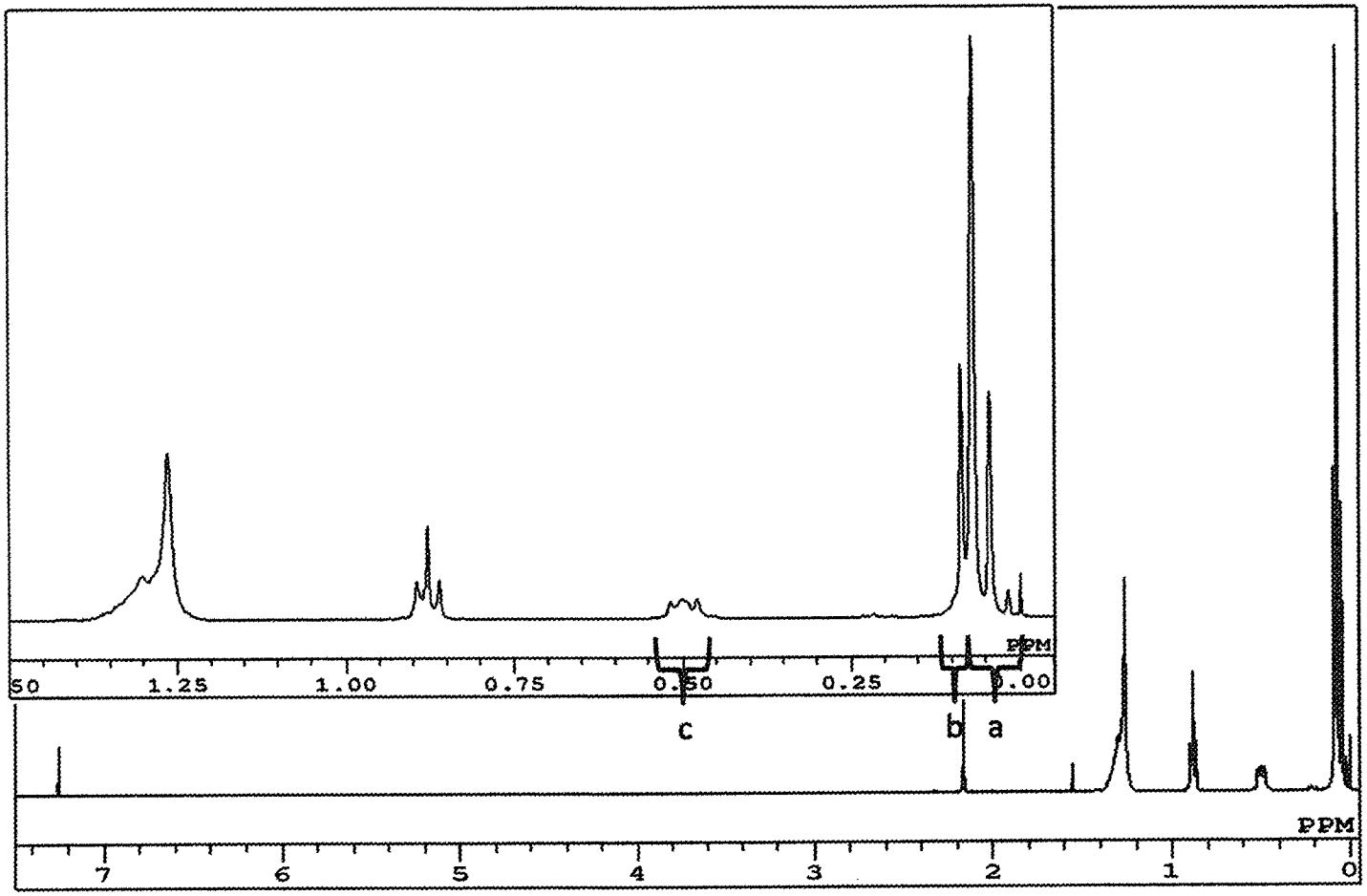
FIG. 4 shows an NMR data of Silicone A-4 synthesized in the embodiment.

The NMR data of Silicone A-4 is shown in FIG. 4.

$^1$H-NMR (solvent: deuterated chloroform, primary standard substance: TMS)

When the integrated value at δ=0.40 to 0.60 ppm is 10.0, the integrated value at δ=0.01 to 0.08 ppm is 80.8, and the integrated value at δ=0.08 to 0.10 ppm is 19.1.

(Synthesis Example 5: Silicone A-5)

225 g of methylhydrogenpolysiloxane (Product Name: KF-99) produced by Shin-Etsu Chemical Co., Ltd., 573 g of decamethylcyclopentasiloxane (Product Name: KF-995) produced by Shin-Etsu Chemical Co., Ltd., 102 g of hexamethyldisiloxane (Product Name: KF-96L-0.65CS) produced by Shin-Etsu Chemical Co. Ltd., and 8 g of activated clay were put in a 2-liter separable flask, and stirred at 90° C. for 3 hours. The activated clay was removed by filtration after the solution was cooled to a room temperature.

Subsequently, the filtrate was put in a 2-liter four-necked flask, and was heated and decompressed to remove silicone compounds having a low molecular weight. As a result, 665 g of dimethyl siloxane-methylhydrogensiloxane copolymer (Silicone D) having both molecular chain ends blocked with trimethylsiloxy group was obtained. The obtained Silicone D was brought into reaction with an excessive amount of aqueous solution of sodium hydroxide and n-butanol, and a generation amount of hydrogen gas was measured. The generation amount of hydrogen gas was 84 mL/g. An amount of hydrogen derived from hydrosilyl group in Silicone D, which was calculated from the obtained amount of hydrogen gas, was seen to be 0.38 mass %. 600 g of Silicone D was put in a 1-liter four-necked flask, and 319 g (i.e., 2.84 mol) of 1-octene (Product Name: LINEALENE 8) produced by Idemitsu Kosan Co., Ltd. and 60 μL (converted in Pt: 3 ppm) of Pt-CTS-toluene solution, which is a platinum catalyst, produced by N. E. CHEMCAT Corporation were put on a dropping funnel to undergo a nitrogen substitution. Silicone D was heated, and dropping of the mixture of 1-octene and the platinum catalyst was started when the liquid temperature reached 60° C. At this moment, the dropping speed was regulated so as to keep the liquid temperature between 80° C. and 110° C. After all the mixture of 1-octene and the platinum catalyst were dropped, the reactants were developed at 100° C. for 2 hours. After having been developed, the disappearance of the peak in SiH groups was confirmed by use of $^1$H-NMR. Subsequently, the resultant was heated and decompressed to remove an excessive amount of 1-octene from the reactants. As a result, 836 g of dimethyl siloxane-methyloctylsiloxane copolymer (Silicone A-5) having both molecular chain ends blocked with trimethylsiloxy group was obtained.

As a result of analysis on the obtained Silicone A-5 by use of $^1$H-NMR, it was found that: the average molecular weight was 2454; the average number of units ($n_1$) having an organic group $R_1$ (C8) was 6.9; the average number of units ($n_2$) having an organic group $R_1$' (C1) was 14.9; and the ratio C/Si in the molecular structure was 4.10.

Figure 5:
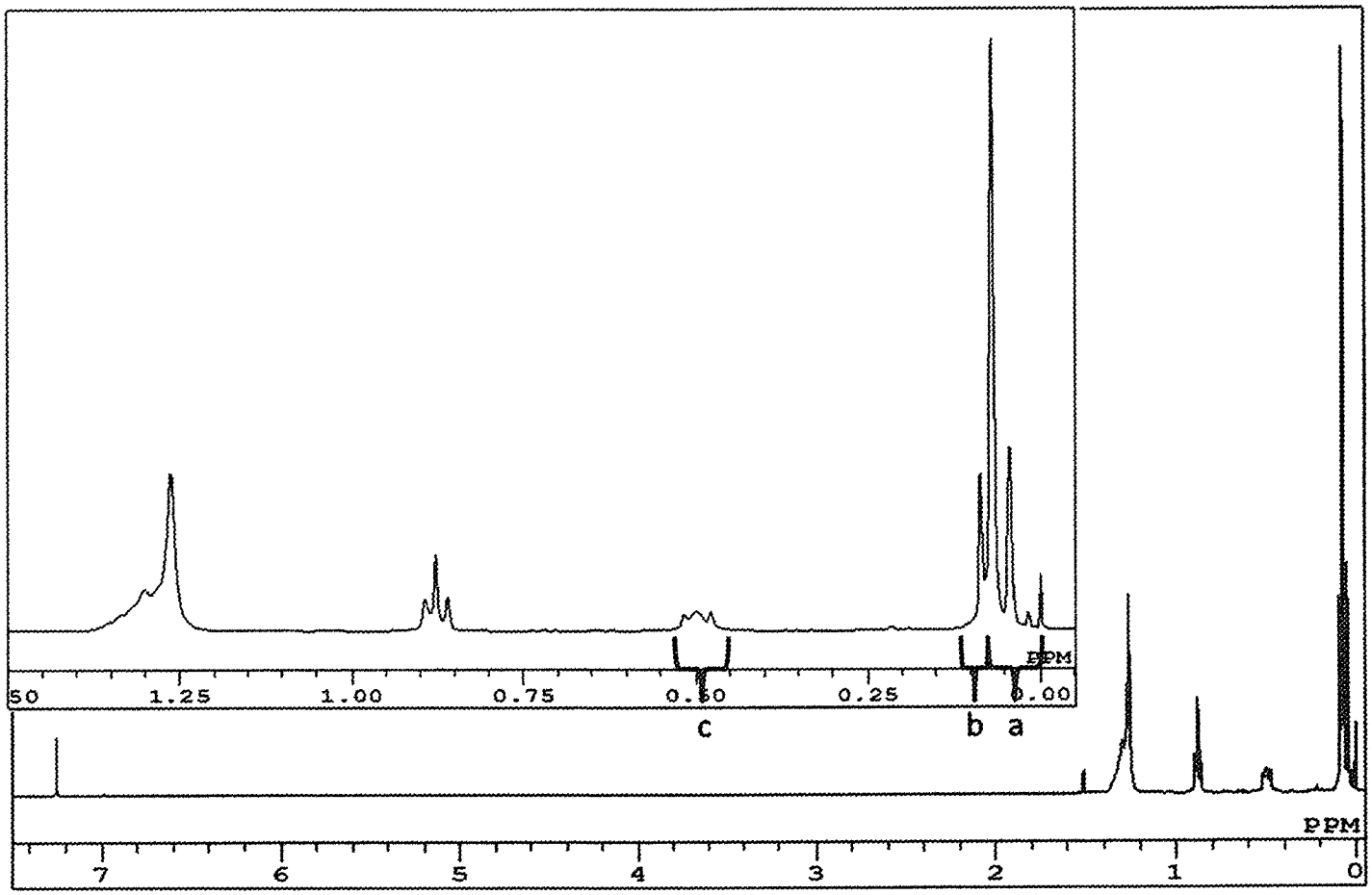
FIG. 5 shows an NMR data of Silicone A-5 synthesized in the embodiment.

The NMR data of Silicone A-5 is shown in FIG. 5.

$^1$H-NMR (solvent: deuterated chloroform, primary standard substance: TMS)

When the integrated value at δ=0.40 to 0.60 ppm is 10.0, the integrated value at δ=0.01 to 0.08 ppm is 80.2, and the integrated value at δ=0.08 to 0.10 ppm is 13.1.

(Synthesis Example 6: Silicone A-6)

451 g of methylhydrogenpolysiloxane (Product Name: KF-99) produced by Shin-Etsu Chemical Co., Ltd., 1149 g of decamethylcyclopentasiloxane (Product Name: KF-995) produced by Shin-Etsu Chemical Co., Ltd., 57 g of hexamethyldisiloxane (Product Name: KF-96L-0.65CS) produced by Shin-Etsu Chemical Co. Ltd., and 10 g of activated clay were put in a 2-liter separable flask, and stirred at 90° C. for 4.5 hours. The activated clay was removed by filtration after the solution was cooled to a room temperature.

Subsequently, the filtrate was put in a 2-liter four-necked flask, and was heated and decompressed to remove silicone compounds having a low molecular weight. As a result, 1474 g of dimethylsiloxane-methylhydrogensiloxane copolymer (Silicone E) having both molecular chain ends blocked with trimethylsiloxy group was obtained. The obtained Silicone E was brought into reaction with an excessive amount of aqueous solution of sodium hydroxide and n-butanol, and a generation amount of hydrogen gas was measured. The generation amount of hydrogen gas was 96 mL/g. An amount of hydrogen derived from hydrosilyl group in Silicone E, which was calculated from the obtained amount of hydrogen gas, was seen to be 0.43 mass %.

641 g of Silicone E was put in a 2-liter four-necked flask, and 382 g (i.e., 3.41 mol) of 1-octene (Product Name: LINEALENE 8) produced by Idemitsu Kosan Co., Ltd. and 80 μL (converted in Pt: 3 ppm) of Pt-CTS-toluene solution, which is a platinum catalyst, produced by N. E. CHEMCAT Corporation were put on a dropping funnel to undergo a nitrogen substitution. Silicone E was heated, and dropping of the mixture of 1-octene and the platinum catalyst was started when the liquid temperature reached 60° C. At this moment, the dropping speed was regulated so as to keep the liquid temperature between 80° C. and 110° C. After all the mixture of 1-octene and the platinum catalyst were dropped, the reactants were developed at 100° C. for 2 hours. After having been developed, the disappearance of the peak in SiH groups was confirmed by use of $^1$H-NMR. Subsequently, the resultant was heated and decompressed to remove an excessive amount of 1-octene from the reactants. As a result, 906 g of dimethyl siloxane-methyloctylsiloxane copolymer (Silicone A-6) having both molecular chain ends blocked with trimethylsiloxy group was obtained.

As a result of analysis on the obtained Silicone A-6 by use of $^1$H-NMR, it was found that: the average molecular weight was 3868; the average number of units ($n_1$) having an organic group $R_1$ (C8) was 11.1; the average number of units ($n_2$) having an organic group $R_1$' (C1) was 24.1; and the ratio C/Si in the molecular structure was 4.14.

Figure 6:
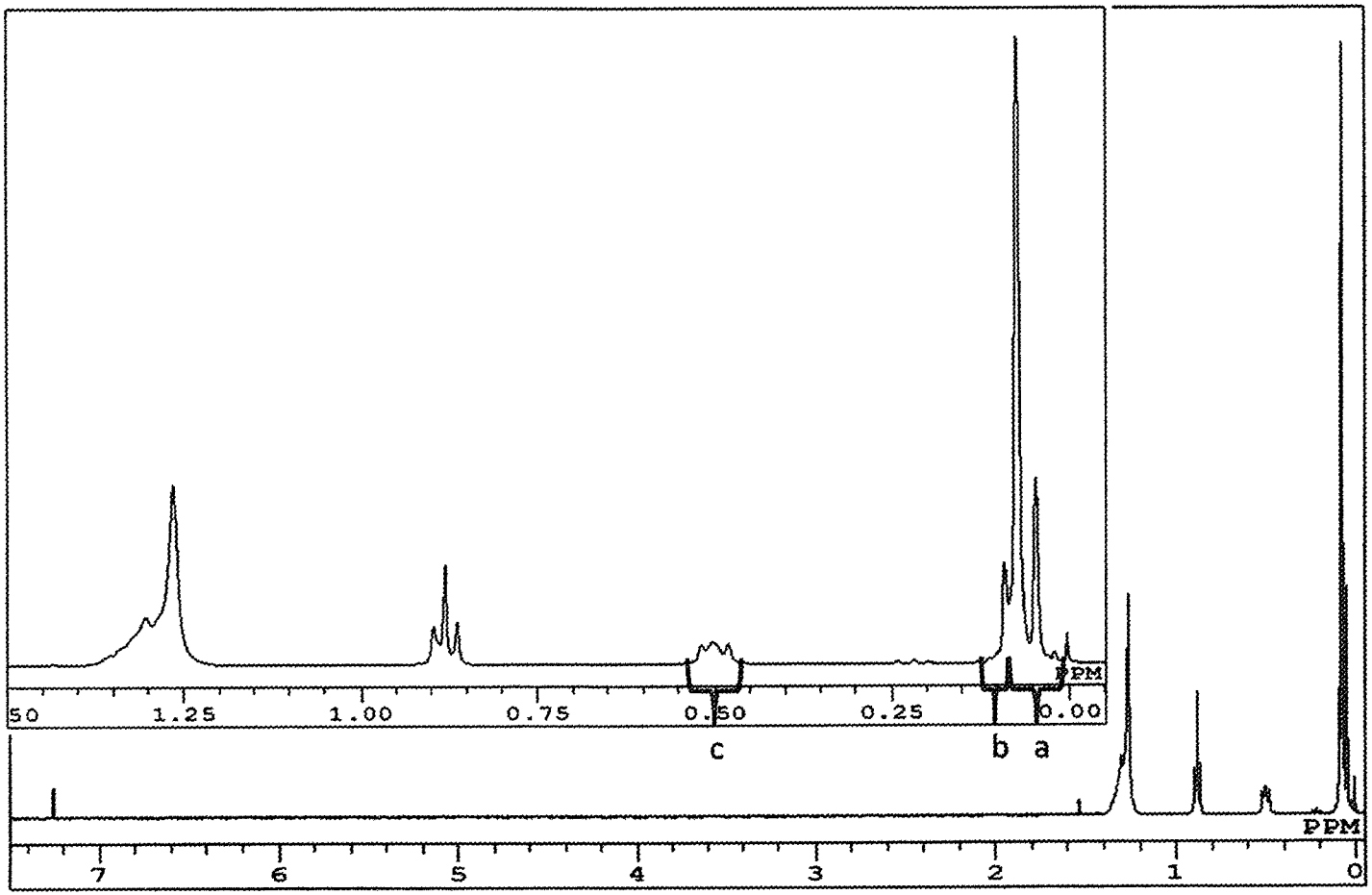
FIG. 6 shows an NMR data of Silicone A-6 synthesized in the embodiment.

The NMR data of Silicone A-6 is shown in FIG. 6.

$^1$H-NMR (solvent: deuterated chloroform, primary standard substance: TMS)

When the integrated value at δ=0.40 to 0.60 ppm is 10.0, the integrated value at δ=0.01 to 0.08 ppm is 80.2, and the integrated value at δ=0.08 to 0.10 ppm is 8.1.

(Synthesis Example 7: Silicone A-7)

700 g of methylhydrogenpolysiloxane (Product Name: KF-99) produced by Shin-Etsu Chemical Co., Ltd., 791 g of decamethylcyclopentasiloxane (Product Name: KF-995) produced by Shin-Etsu Chemical Co., Ltd., 325 g of hexamethyldisiloxane (Product Name: KF-96L-0.65CS) produced by Shin-Etsu Chemical Co, Ltd., and 11 g of activated clay were put in a 2-liter separable flask, and stirred at 90° C. for 6 hours. The activated clay was removed by filtration after the solution was cooled to a room temperature.

Subsequently, the filtrate was put in a 2-liter four-necked flask, and was heated and decompressed to obtain 980 g of dimethylsiloxane-methylhydrogensiloxane copolymer (Silicone F) having both molecular chain ends blocked with trimethylsiloxy group as a distillate. The obtained Silicone F was brought into reaction with an excessive amount of aqueous solution of sodium hydroxide and n-butanol, and a generation amount of hydrogen gas was measured. The generation amount of hydrogen gas was 130 mL/g. An amount of hydrogen derived from hydrosilyl group in Silicone F, which was calculated from the obtained amount of hydrogen gas, was seen to be 0.58 mass %.

99 g of Silicone F was put in a 500-mililiter four-necked flask, and 102 g (i.e., 1.21 mol) of 1-hexene (Product Name: LINEALENE 6) produced by Idemitsu Kosan Co., Ltd. and 60 μL (converted in Pt: 15 ppm) of Pt-CTS-toluene solution, which is a platinum catalyst, produced by N. E. CHEMCAT Corporation were put on a dropping funnel to undergo a nitrogen substitution. Silicone F was heated, and dropping of the mixture of 1-hexene and the platinum catalyst was started when the liquid temperature reached 60° C. At this moment, the dropping speed was regulated so as to keep the liquid temperature between 80° C. and 110° C. After all the mixture of 1-hexene and the platinum catalyst were dropped, the reactants were developed at 90° C. for 1 hour. After having been developed, the disappearance of the peak in SiH groups was confirmed by use of $^1$H-NMR. Subsequently, the resultant was heated and decompressed to remove an excessive amount of 1-hexene from the reactants. As a result, 130 g of dimethylsiloxane-methylhexylsiloxane copolymer (Silicone A-7) having both molecular chain ends blocked with trimethylsiloxy group was obtained.

As a result of analysis on the obtained Silicone A-7 by use of $^1$H-NMR, it was found that: the average molecular weight was 850; the average number of units ($n_1$) having an organic group $R_1$ (C6) was 3.3; the average number of units ($n_2$) having an organic group $R_1'$ (C1) was 2.9; and the ratio C/Si in the molecular structure was 4.25.

Figure 7:
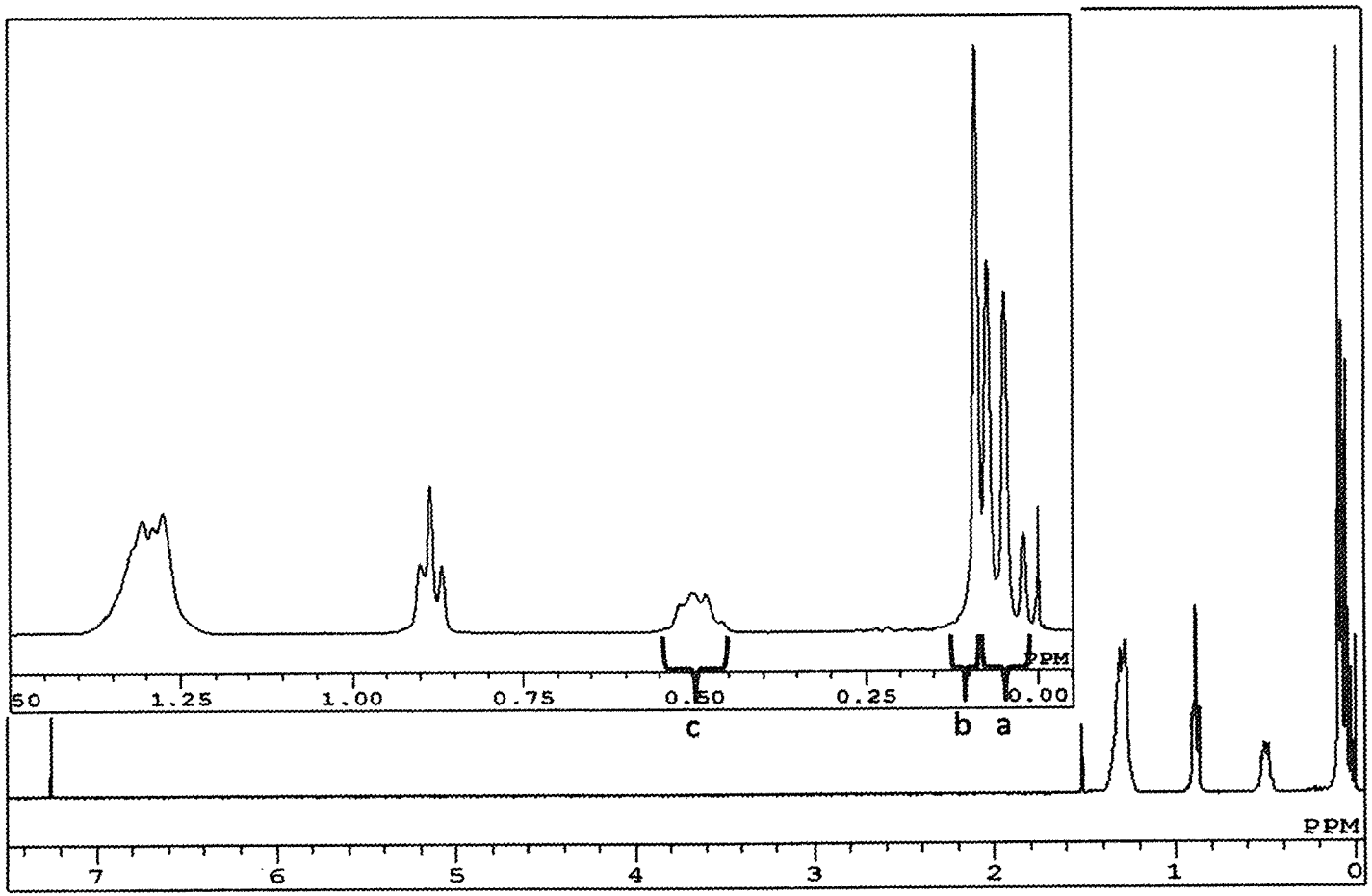
FIG. 7 shows an NMR data of Silicone A-7 synthesized in the embodiment.

The NMR data of Silicone A-7 is shown in FIG. 7.

$^1$H-NMR (solvent: deuterated chloroform, primary standard substance: TMS)

When the integrated value at δ=0.40 to 0.60 ppm is 10.0,
the integrated value at δ=0.01 to 0.08 ppm is 41.6, and
the integrated value at δ=0.08 to 0.10 ppm is 27.5.

(Synthesis Example 8: Silicone A-8)

900 g of methylhydrogenpolysiloxane (Product Name: KF-99) produced by Shin-Etsu Chemical Co., Ltd., 658 g of decamethylcyclopentasiloxane (Product Name: KF-995) produced by Shin-Etsu Chemical Co., Ltd., 335 g of hexamethyldisiloxane (Product Name: KF-96L-0.65CS) produced by Shin-Etsu Chemical Co. Ltd., and 11 g of activated clay were put in a 2-liter separable flask, and stirred at 90° C. for 6 hours. The activated clay was removed by filtration after the solution was cooled to a room temperature.

Subsequently, the filtrate was put in a 2-liter four-necked flask, and was heated and decompressed to obtain 966 g of dimethylsiloxane-methylhydrogensiloxane copolymer (Silicone G) having both molecular chain ends blocked with trimethylsiloxy group as a distillate. The obtained Silicone G was brought into reaction with an excessive amount of aqueous solution of sodium hydroxide and n-butanol, and a generation amount of hydrogen gas was measured. The generation amount of hydrogen gas was 155 mL/g. An amount of hydrogen derived from hydrosilyl group in Silicone G, which was calculated from the obtained amount of hydrogen gas, was seen to be 0.70 mass %.

150 g of Silicone G was put in a 500-mililiter four-necked flask, and 102 g (i.e., 1.22 mol) of 1-hexene (Product Name: LINEALENE 6) produced by Idemitsu Kosan Co., Ltd. and 40 μL (converted in Pt: 7 ppm) of Pt-CTS-toluene solution, which is a platinum catalyst, produced by N. E. CHEMCAT Corporation were put on a dropping funnel to undergo a nitrogen substitution. Silicone G was heated, and dropping of the mixture of 1-hexene and the platinum catalyst was started when the liquid temperature reached 60° C. At this moment, the dropping speed was regulated so as to keep the liquid temperature between 80° C. and 110° C. After all the mixture of 1-hexene and the platinum catalyst were dropped, the reactants were developed at 90° C. for 4.5 hours. After having been developed, the disappearance of the peak in SiH groups was confirmed by use of $^1$H-NMR. Subsequently, the resultant was heated and decompressed to remove an excessive amount of 1-hexene from the reactants. As a result, 184 g of dimethylsiloxane-methylhexylsiloxane copolymer (Silicone A-8) having both molecular chain ends blocked with trimethylsiloxy group was obtained.

As a result of analysis on the obtained Silicone A-8 by use of $^1$H-NMR, it was found that: the average molecular weight was 890; the average number of units ($n_1$) having an organic group $R_1$ (C6) was 3.9; the average number of units ($n_2$) having an organic group $R_1'$ (C1) was 2.2; and the ratio C/Si in the molecular structure was 4.64.

Figure 8:
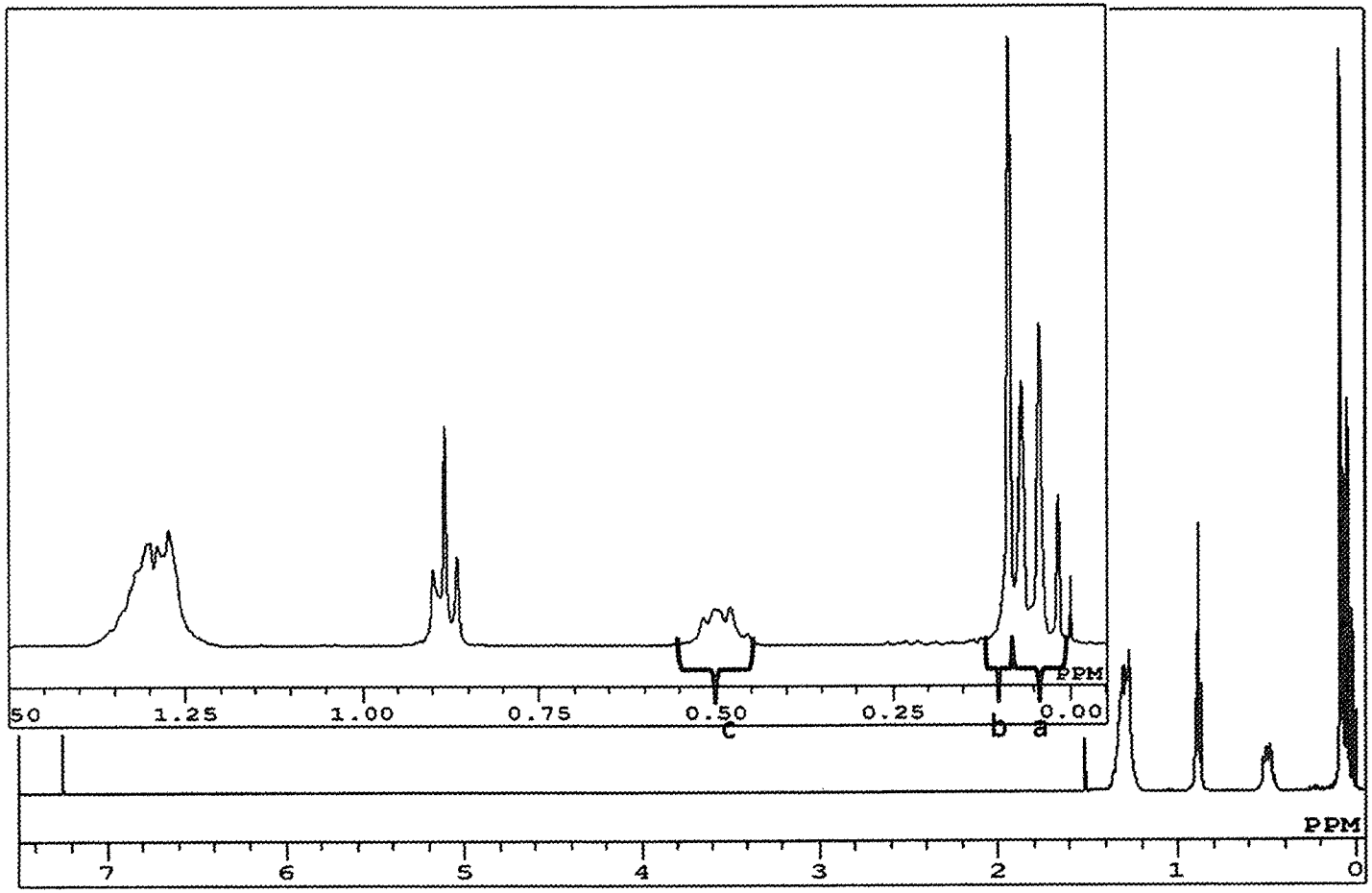
FIG. 8 shows an NMR data of Silicone A-8 synthesized in the embodiment.

The NMR data of Silicone A-8 is shown in FIG. 8.

$^1$H-NMR (solvent: deuterated chloroform, primary standard substance: TMS)

When the integrated value at δ=0.40 to 0.60 ppm is 10.0,
the integrated value at δ=0.01 to 0.08 ppm is 32.2, and
the integrated value at δ=0.08 to 0.10 ppm is 23.1.

(Synthesis Example 9: Silicone A-9)

94 g of Silicone C obtained in Synthesis Example 3 was put in a 500-mililiter four-necked flask, and 162 g (i.e., 1.16 mol) of 1-decene (Product Name: LINEALENE 10) produced by Idemitsu Kosan Co., Ltd. and 120 μL, (converted in Pt: 34 ppm) of Pt-CTS-toluene solution, which is a platinum catalyst, produced by N. E. CHEMCAT Corporation were put on a dropping funnel to undergo a nitrogen substitution. Silicone C was heated, and dropping of the mixture of 1-decene and the platinum catalyst was started when the liquid temperature reached 60° C. At this moment, the dropping speed was regulated so as to keep the liquid temperature between 80° C. and 110° C. After all the mixture of 1-decene and the platinum catalyst were dropped, the reactants were developed at 90° C. for 24 hours. After having been developed, the disappearance of the peak in SiH groups was confirmed by use of $^1$H-NMR. Subsequently, the resultant was heated and decompressed to remove an excessive amount of 1-decene from the reactants. As a result, 131 g of dimethylsiloxane-methyldecylsiloxane copolymer (Silicone A-9) having both molecular chain ends blocked with trimethylsiloxy group was obtained.

As a result of analysis on the obtained Silicone A-9 by use of $^1$H-NMR, it was found that: the average molecular weight was 1654; the average number of units ($n_1$) having an organic group $R_1$ (C10) was 4.1; the average number of units ($n_2$) having an organic group $R_1'$ (C1) was 9.0; and the ratio C/Si in the molecular structure was 4.60.

Figure 9:
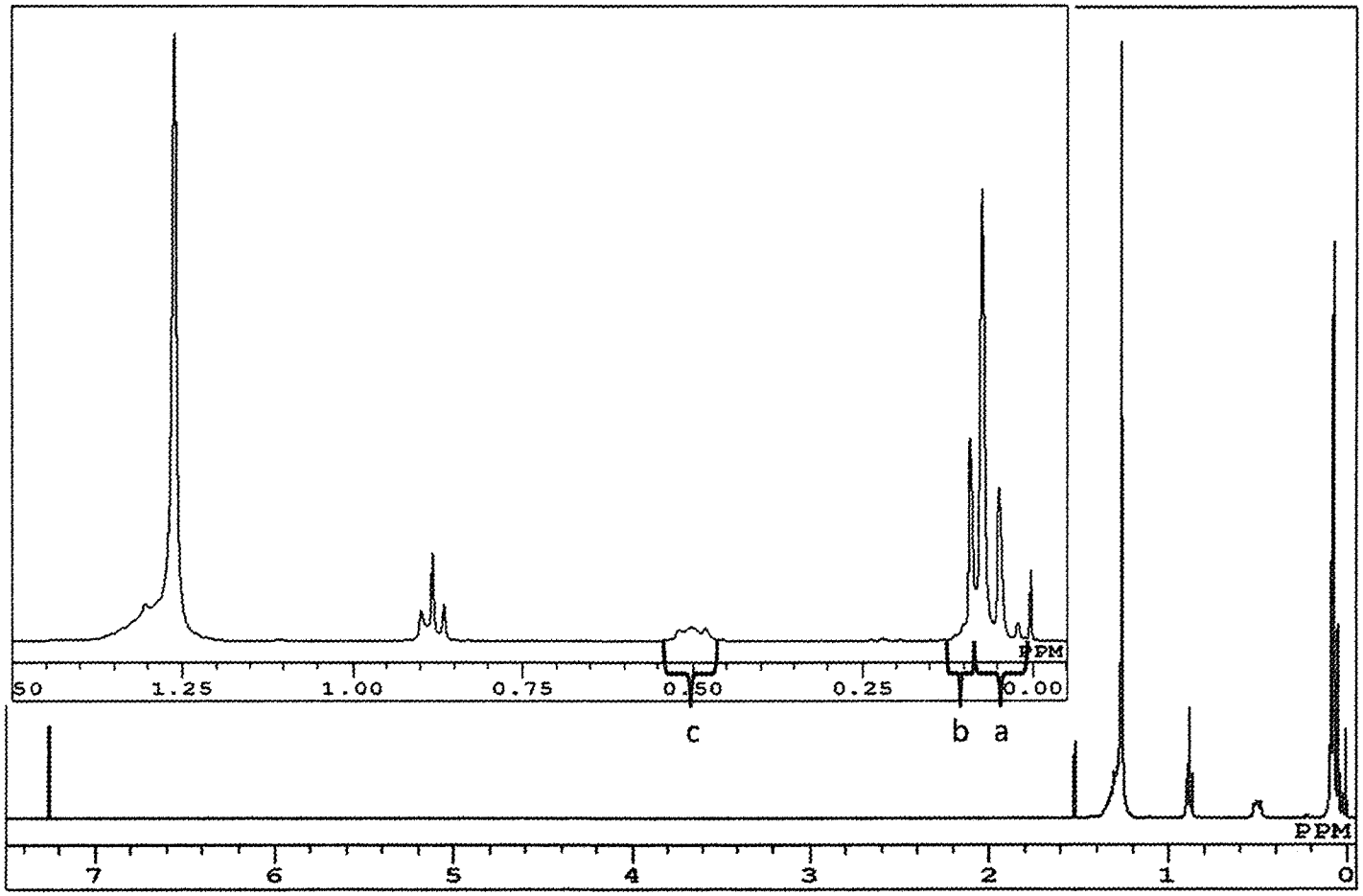
FIG. 9 shows an NMR data of Silicone A-9 synthesized in the embodiment.

The NMR data of Silicone A-9 is shown in FIG. 9.

$^1$H-NMR (solvent: deuterated chloroform, primary standard substance: TMS)

When the integrated value at δ=0.40 to 0.60 ppm is 10.0, the integrated value at δ=0.01 to 0.08 ppm is 80.1, and the integrated value at δ=0.08 to 0.10 ppm is 21.8.

(Synthesis Example 10: Silicone A-10)

45 g of Silicone C obtained in Synthesis Example 3 was put in a 500-mililiter four-necked flask, and 68 g (i.e., 0.40 mol) of 1-dodecene (Product Name: LINEALENE 12) produced by Idemitsu Kosan Co., Ltd. and 30 μL (converted in Pt: 17 ppm) of Pt-CTS-toluene solution, which is a platinum catalyst, produced by N. E. CHEMCAT Corporation were put on a dropping funnel to undergo a nitrogen substitution. Silicone C was heated, and dropping of the mixture of 1-dodecene and the platinum catalyst was started when the liquid temperature reached 60° C. At this moment, the dropping speed was regulated so as to keep the liquid temperature between 80° C. and 110° C. After all the mixture of 1-dodecene and the platinum catalyst were dropped, the reactants were developed at 90° C. for 8 hours. After having been developed, the disappearance of the peak in SiH groups was confirmed by use of $^1$H-NMR. Subsequently, the resultant was heated and decompressed to remove an excessive amount of 1-dodecene from the reactants. As a result, 72 g of dimethylsiloxane-methyldodecylsiloxane copolymer (Silicone A-10) having both molecular chain ends blocked with trimethylsiloxy group was obtained.

As a result of analysis on the obtained Silicone A-10 by use of $^1$H-NMR, it was found that: the average molecular weight was 1728; the average number of units ($n_1$) having an organic group $R_1$ (C12) was 3.9; the average number of units ($n_2$) having an organic group $R_1'$ (C1) was 9.0; and the ratio C/Si in the molecular structure was 5.03.

Figure 10:
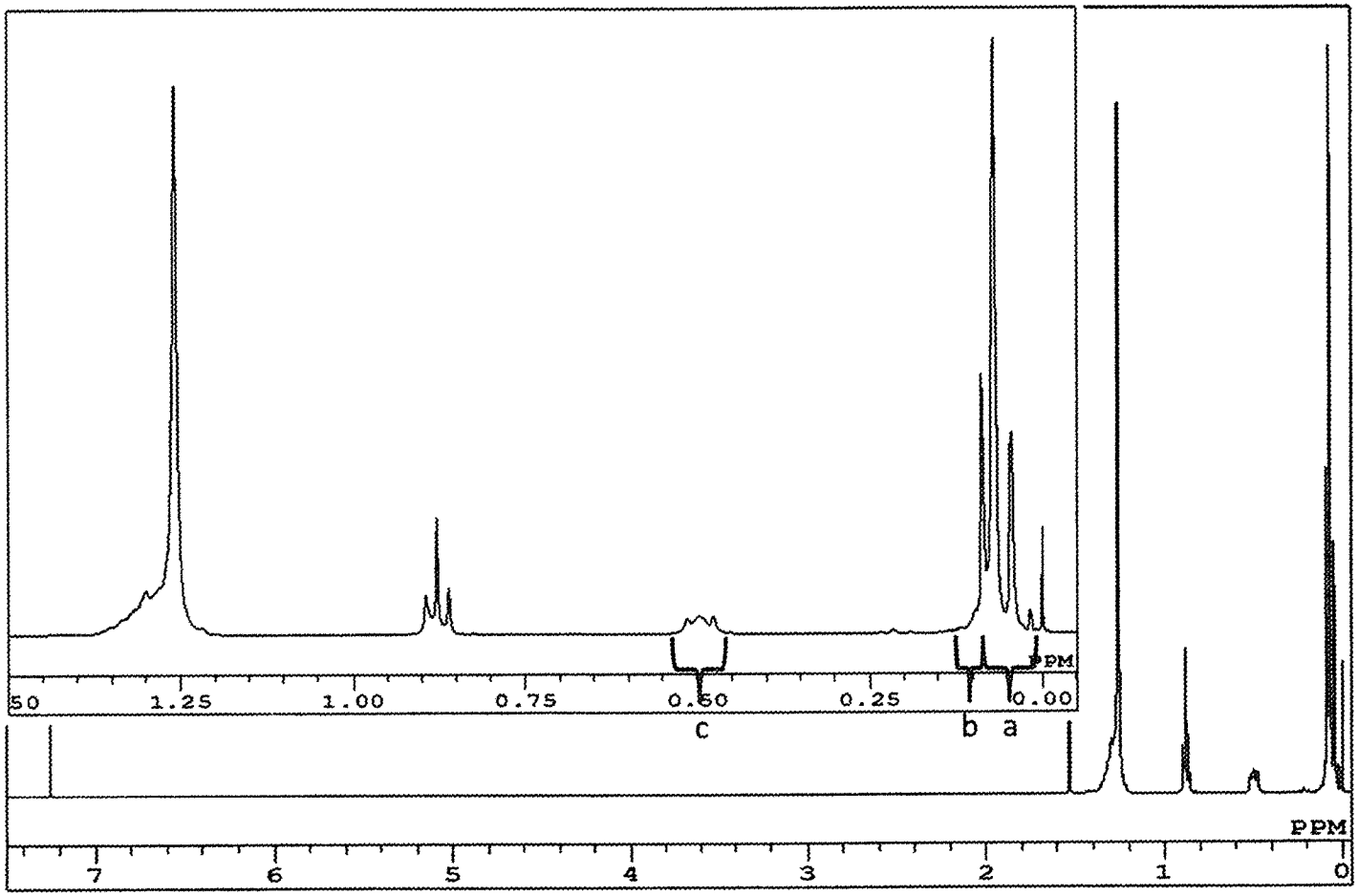
FIG. 10 shows an NMR data of Silicone A-10 synthesized in the embodiment.

The NMR data of Silicone A-10 is shown in FIG. 10.

$^1$H-NMR (solvent: deuterated chloroform, primary standard substance: TMS)

When the integrated value at δ=0.40 to 0.60 ppm is 10.0, the integrated value at δ=0.01 to 0.08 ppm is 83.7, and the integrated value at δ=0.08 to 0.10 ppm is 22.9.

(Synthesis Example 11: Silicone A-11)

56g of Silicone C obtained in Synthesis Example 3 was put in a 500-mililiter four-necked flask, and 181 g (i.e., 0.93 mol) of 1-tetradecene (Product Name: LINEALENE 14) produced by Idemitsu Kosan Co., Ltd. and 60 μL (converted in Pt: 28 ppm) of Pt-CTS-toluene solution, which is a platinum catalyst, produced by N. E. CHEMCAT Corporation were put on a dropping funnel to undergo a nitrogen substitution. Silicone C was heated, and dropping of the mixture of 1-tetradecene and the platinum catalyst was started when the liquid temperature reached 60° C. At this moment, the dropping speed was regulated so as to keep the liquid temperature between 80° C. and 110° C. After all the mixture of 1-tetradecene and the platinum catalyst were dropped, the reactants were developed at 90° C. for 4 hours. After having been developed, the disappearance of the peak in Sill groups was confirmed by use of $^1$H-NMR. Subsequently, the resultant was heated and decompressed to remove an excessive amount of 1-tetradecene from the reactants. As a result, 104 g of dimethylsiloxane-methyltetradecylsiloxane copolymer (Silicone A-11) having both molecular chain ends blocked with trimethylsiloxy group was obtained.

As a result of analysis on the obtained Silicone A-11 by use of $^1$H-NMR, it was found that: the average molecular weight was 2046; the average number of units ($n_t$) having an organic group $R_1$ (C14) was 4.5; the average number of units ($n_2$) having an organic group $R_1'$ (C1) was 9.9; and the ratio C/Si in the molecular structure was 5.67.

Figure 11:
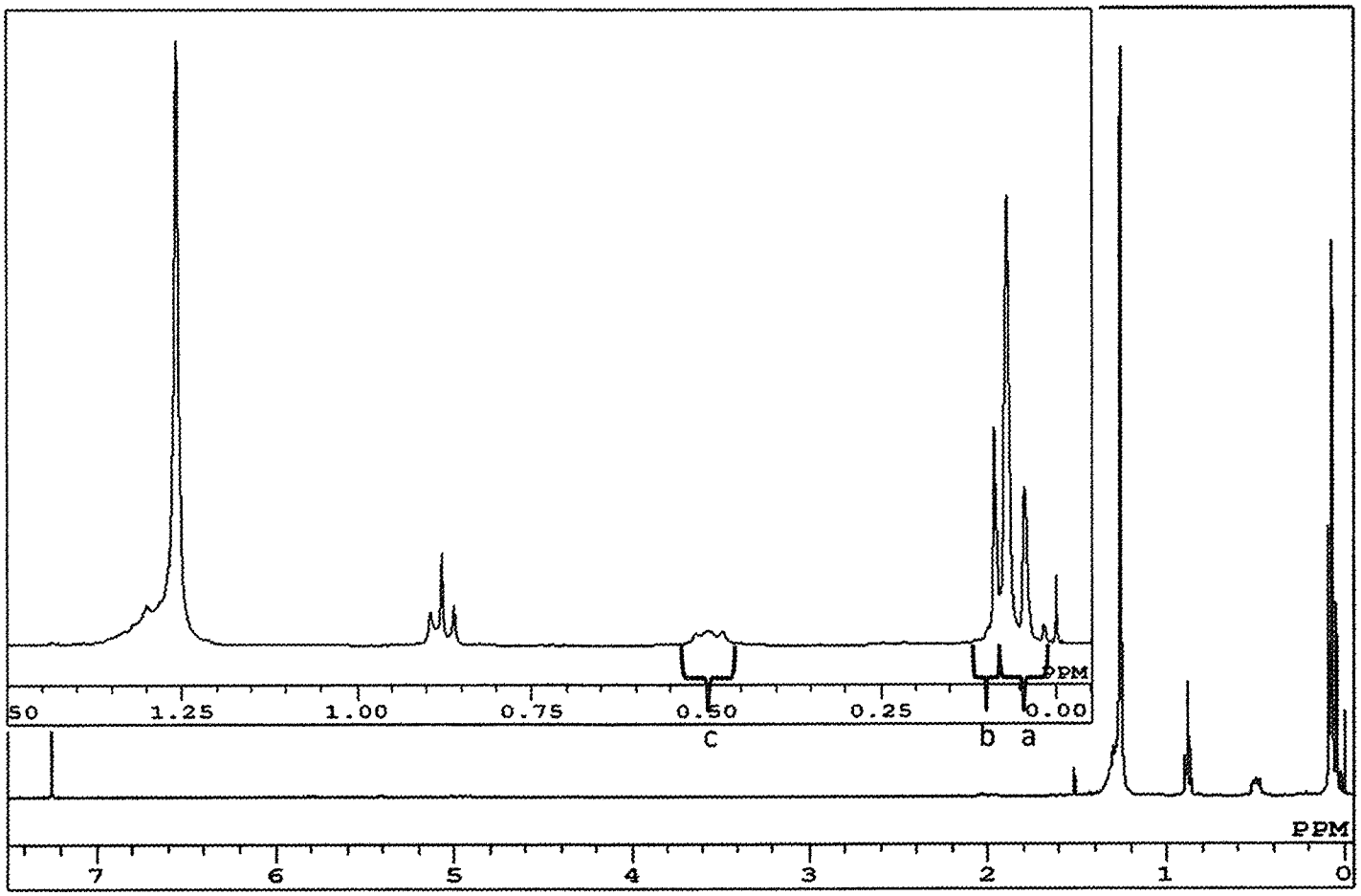
FIG. 11 shows an NMR data of Silicone A-11 synthesized in the embodiment.

The NMR data of Silicone A-11 is shown in FIG. 11.

$^1$H-NMR (solvent: deuterated chloroform, primary standard substance: TMS)

When the integrated value at δ=0.40 to 0.60 ppm is 10.0, the integrated value at δ=0.01 to 0.08 ppm is 81.4, and the integrated value at δ=0.08 to 0.10 ppm is 20.1.

(Synthesis Example 12: Silicone A-12)

1610 g of methylhydrogenpolysiloxane (Product Name: KF-99) produced by Shin-Etsu Chemical Co., Ltd., 338 g of hexamethyldisiloxane (Product Name: KF-96L-0.65CS) produced by Shin-Etsu Chemical Co. Ltd., and 11 g of activated clay were put in a 2-liter separable flask, and stirred at 90° C. for 4 hours. The activated clay was removed by filtration after the solution was cooled to a room temperature.

Subsequently, the filtrate was put in a 2-liter four-necked flask, and was heated and decompressed to obtain 721 g of methylhydrogenpolysiloxane (Silicone H) having both molecular chain ends blocked with trimethylsiloxy group as a distillate and 877 g of methylhydrogenpolysiloxane (Silicone 1) having both molecular chain ends blocked with trimethylsiloxy group remained in the four-necked flask. The obtained Silicone H and Silicone I were respectively brought into reaction with an excessive amount of aqueous solution of sodium hydroxide and n-butanol, and a generation amount of hydrogen gas was measured. The generation amount of hydrogen gas in Silicone H was 276 mL/g. An amount of hydrogen derived from hydrosilyl group in Silicone H, which was calculated from the obtained amount of hydrogen gas, was seen to be 1.24 mass %. The generation amount of hydrogen gas in Silicone I was 323 mL/g. An amount of hydrogen derived from hydrosilyl group in Silicone I, which was calculated from the obtained amount of hydrogen gas, was seen to be 1.45 mass %.

150 g of Silicone H was put in a 500-mililiter four-necked flask, and 202 g (i.e., 2.40 mol) of 1-hexene (Product Name: LINEALENE 6) produced by Idemitsu Kosan Co., Ltd. and 70 μL (converted in Pt: 12 ppm) of Pt-CTS-toluene solution, which is a platinum catalyst, produced by N. E. CHEMCAT Corporation were put on a dropping funnel to undergo a nitrogen substitution. Silicone H was heated, and dropping of the mixture of 1-hexene and the platinum catalyst was started when the liquid temperature reached 60° C. At this moment, the dropping speed was regulated so as to keep the liquid temperature between 80° C. and 110° C. After all the mixture of 1-hexene and the platinum catalyst were dropped, the reactants were developed at 90° C. for 10 hours. After having been developed, the disappearance of the peak in SiH groups was confirmed by use of $^1$H-NMR. Subsequently, the resultant was heated and decompressed to remove an excessive amount of 1-hexene from the reactants. As a result, 206 g of methylhexylpolysiloxane (Silicone A-12) having both molecular chain ends blocked with trimethylsiloxy group was obtained.

As a result of analysis on the obtained Silicone A-12 by use of $^1$H-NMR, it was found that: the average molecular weight was 1292; the average number of units (n) having an organic group $R_1$ (C6) was 7.8; and the ratio C/Si in the molecular structure was 6.19.

Figure 12:
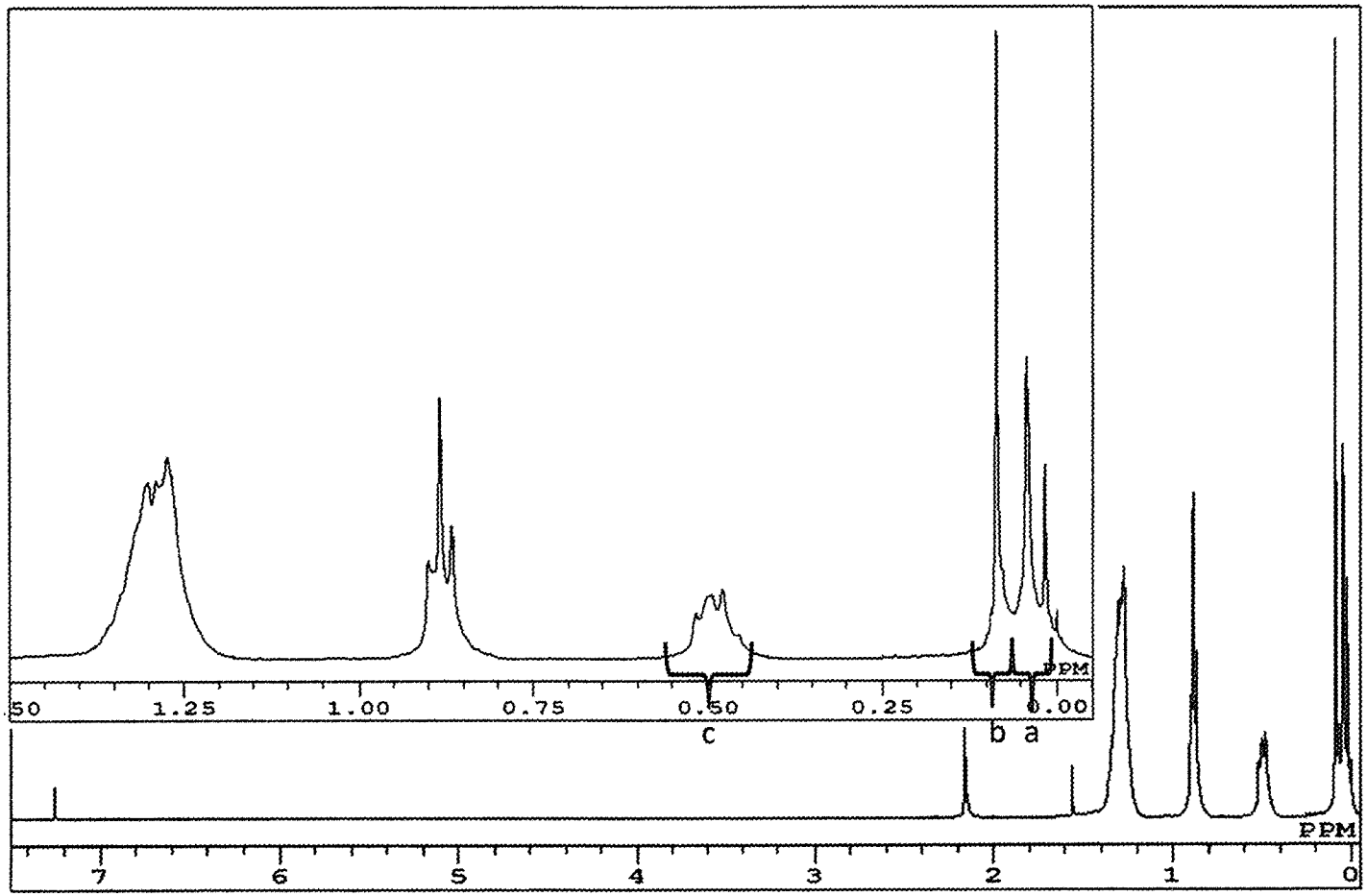
FIG. 12 shows an NMR data of Silicone A-12 synthesized in the embodiment.

The NMR data of Silicone A-12 is shown in FIG. 12.

The $^1$H-NMR analysis on methylalkylpolysiloxane having both molecular chain ends blocked with trimethylsiloxy group shown in A-12 to A-14 was executed in the following manner.

At a (chemical shift: 0.01 to 0.06 ppm) is denoted a peak of hydrogen derived from a methyl group in a unit having an organic group R.

At b (chemical shift: 0.075 to 0.10 ppm) is denoted a peak of hydrogen derived from a methyl group in trimethylsiloxy group at both molecular chain ends.

At c (chemical shift: 0.40 to 0.60 ppm) is denoted a peak of hydrogen derived from $CH_2$ group adjacent to silicon in an organic group R.

The average molecular weight and the average number of units having an organic group R were calculated by the following equations (3) on the basis of the integrated value (ratio) of the peaks of the a, b, and c.

Average number of units (alkyl group) having an organic group R=$c \div 2 \times 18 \div b$ Average molecular weight=Average number of units having an organic group R×Molecular weight of a unit having an organic group R+Molecular weight of a trimethylsiloxy group at both molecular chain ends Equations (3)

$^1$H-NMR (solvent: deuterated chloroform, primary standard substance: TMS)

When the integrated value at δ=0.40 to 0.60 ppm is 10.0, the integrated value at δ=0.08 to 0.10 ppm is 11.5.

(Synthesis Example 13: Silicone A-13)

152 g of Silicone I obtained in Synthesis Example 12 was put in a 500-mililiter four-necked flask, and 209 g (i.e., 2.48 mol) of 1-hexene (Product Name: LINEALENE 6) produced by Idemitsu Kosan Co., Ltd. and 70 μL (converted in Pt: 12 ppm) of Pt-CTS-toluene solution, which is a platinum catalyst, produced by N. E. CHEMCAT Corporation were put on a dropping funnel to undergo a nitrogen substitution. Silicone I was heated, and dropping of the mixture of 1-hexene and the platinum catalyst was started when the liquid temperature reached 60° C. At this moment, the dropping speed was regulated so as to keep the liquid temperature between 80° C. and 110° C. After all the mixture of 1-hexene and the platinum catalyst were dropped, the reactants were developed at 90° C. for 10 hours. After having been developed, the disappearance of the peak in SiH groups was confirmed by use of $^1$H-NMR. Subsequently, the resultant was heated and decompressed to remove an excessive amount of 1-hexene from the reactants. As a result, 231 g of methylhexylpolysiloxane (Silicone A-13) having both molecular chain ends blocked with trimethylsiloxy group was obtained.

As a result of analysis on the obtained Silicone A-13 by use of $^1$H-NMR, it was found that: the average molecular weight was 2613; the average number of units (n) having an organic group $R_1$ (C6) was 17.0; and the ratio C/Si in the molecular structure was 6.58.

Figure 13:
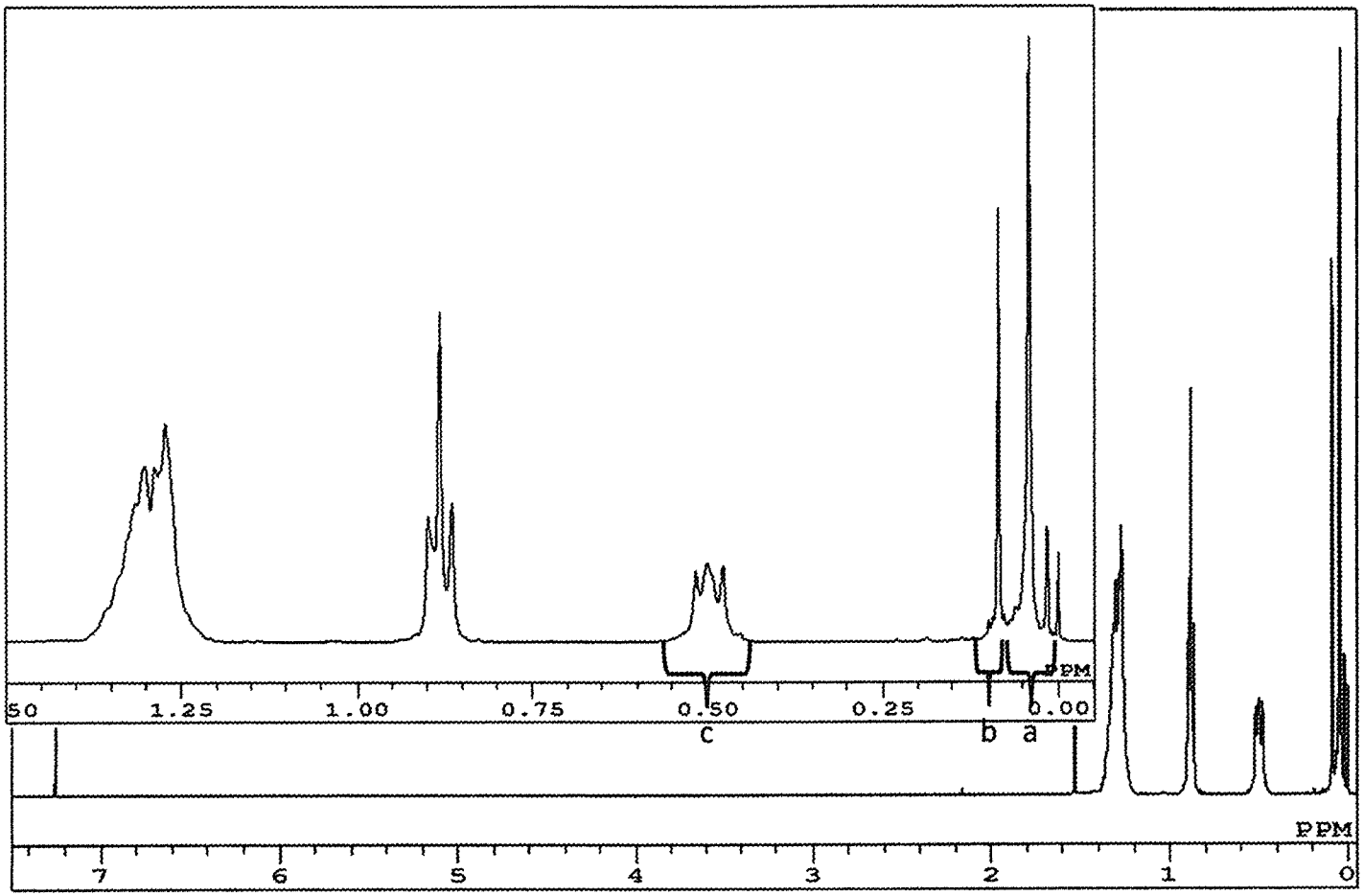
FIG. 13 shows an NMR data of Silicone A-13 synthesized in the embodiment.

The NMR data of Silicone A-13 is shown in FIG. 13.

$^1$H-NMR (solvent: deuterated chloroform, primary standard substance: TMS)

When the integrated value at δ=0.40 to 0.60 ppm is 10.0, the integrated value at δ=0.08 to 0.10 ppm is 5.3.

(Synthesis Example 14: Silicone A-14)

1610 g of methylhydrogenpolysiloxane (Product Name: KF-99) produced by Shin-Etsu Chemical Co., Ltd., 293 g of hexamethyldisiloxane (Product Name: KF-96L-0.65CS) produced by Shin-Etsu Chemical Co. Ltd., and 11 g of activated clay were put in a 2-liter separable flask, and stirred at 90° C. for 7 hours. The activated clay was removed by filtration after the solution was cooled to a room temperature.

Subsequently, the filtrate was put in a 2-liter four-necked flask, and was heated and decompressed to obtain 990 g of methylhydrogenpolysiloxane (Silicone J) having both molecular chain ends blocked with trimethylsiloxy group as a distillate. The obtained Silicone J was brought into reaction with an excessive amount of aqueous solution of sodium hydroxide and n-butanol, and a generation amount of hydrogen gas was measured. The generation amount of hydrogen gas was 339 mL/g. An amount of hydrogen derived from hydrosilyl group in Silicone J, which was calculated from the obtained amount of hydrogen gas, was seen to be 1.53 mass %.

150 g of Silicone J was put in a 500-mililiter four-necked flask, and 171 g (i.e., 2.03 mol) of 1-hexene (Product Name: LINEALENE 6) produced by Idemitsu Kosan Co., Ltd. and 90 μL (converted in Pt: 16 ppm) of Pt-CTS-toluene solution, which is a platinum catalyst, produced by N. E. CHEMCAT Corporation were put on a dropping funnel to undergo a nitrogen substitution. Silicone J was heated, and dropping of the mixture of 1-hexene and the platinum catalyst was started when the liquid temperature reached 60° C. At this moment, the dropping speed was regulated so as to keep the liquid temperature between 80° C. and 110° C. After all the mixture of 1-hexene and the platinum catalyst were dropped, the reactants were developed at 110° C. for 5 hours. After having been developed, the disappearance of the peak in SiH groups was confirmed by use of $^1$H-NMR. Subsequently, the resultant was heated and decompressed to remove an excessive amount of 1-hexene from the reactants. As a result, 211 g of methylhexylpolysiloxane (Silicone A-14) having both molecular chain ends blocked with trimethylsiloxy group was obtained.

As a result of analysis on the obtained Silicone A-14 by use of $^1$H-NMR, it was found that: the average molecular weight was 3982; the average number of units (n) having an organic group $R_1$ (C6) was 26.5; and the ratio C/Si in the molecular structure was 6.72.

Figure 14:
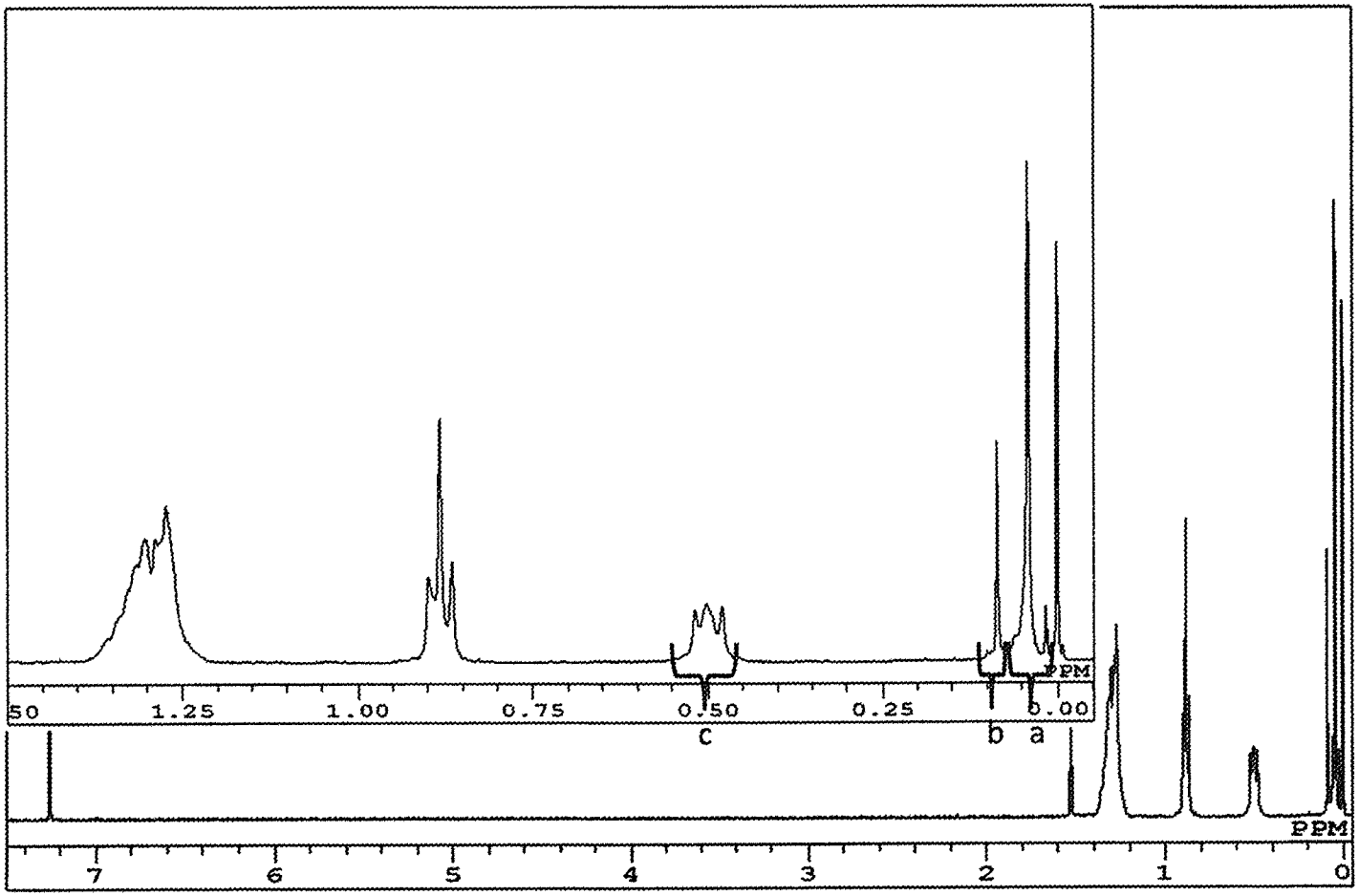
FIG. 14 shows an NMR data of Silicone A-14 synthesized in the embodiment.

The NMR data of Silicone A-14 is shown in FIG. 14.

$^1$H-NMR (solvent: deuterated chloroform, primary standard substance: TMS)

When the integrated value at δ=0.40 to 0.60 ppm is 10.0, the integrated value at δ=0.08 to 0.10 ppm is 3.4.

(Synthesis Example 15: Silicone A-15)

450 g of tetramethylcyclotetrasiloxane produced by Tokyo Chemical Industry Co., Ltd., 1257 g of decamethylcyclopentasiloxane (Product Name: KF-995) produced by Shin-Etsu Chemical Co., Ltd., 326 g of tetramethyldisiloxane produced by Tokyo Chemical Industry Co., Ltd., and 12 g of activated clay were put in a 2-liter separable flask, and stirred at 90° C. for 12 hours. The activated clay was removed by filtration after the solution was cooled to a room temperature.

Subsequently, the filtrate was put in a 2-liter four-necked flask, and was heated and decompressed to obtain 120 g of methylhydrogenpolysiloxane (Silicone K) having both molecular chain ends blocked with dimethylsiloxy group as a distillate. The obtained Silicone K was brought into reaction with an excessive amount of aqueous solution of sodium hydroxide and n-butanol, and a generation amount of hydrogen gas was measured. The generation amount of hydrogen gas was 93 mL/g. An amount of hydrogen derived from hydrosilyl group in Silicon K, which was calculated from the obtained amount of hydrogen gas, was seen to be 0.42 mass %.

45 g of Silicone K was put in a 500-mililiter four-necked flask, and 58 g (i.e., 0.52 mol) of 1-octene (Product Name: LINEALENE 8) produced by Idemitsu Kosan Co., Ltd. and 30 μL (converted in Pt: 8 ppm) of Pt-CTS-toluene solution, which is a platinum catalyst, produced by N. E. CHEMCAT Corporation were put on a dropping funnel to undergo a nitrogen substitution. Silicone K was heated, and dropping of the mixture of 1-octene and the platinum catalyst was started when the liquid temperature reached 60° C. At this moment, the dropping speed was regulated so as to keep the liquid temperature between 80° C. and 110° C. After all the mixture of 1-octene and the platinum catalyst were dropped, the reactants were developed at 130° C. for 10 hours. After having been developed, the disappearance of the peak in SiH groups was confirmed by use of $^1$H-NMR. Subsequently, the resultant was heated and decompressed to remove an excessive amount of 1-octene from the reactants. As a result, 66 g of dimethylsiloxane-methyloctylsiloxane copolymer (Silicone A-15) having both molecular chain ends blocked with dimethyloctylsiloxy group was obtained.

As a result of analysis on the obtained Silicone A-15 by use of $^1$H-NMR, it was found that: the average molecular weight was 1346; the average number of units ($n_1$) having an organic group $R_1$ (C8) was 3.2; the average number of units ($n_2$) having an organic group $R_1'$ (C1) was 5.9; and the ratio C/Si in the molecular structure was 5.44.

Figure 15:
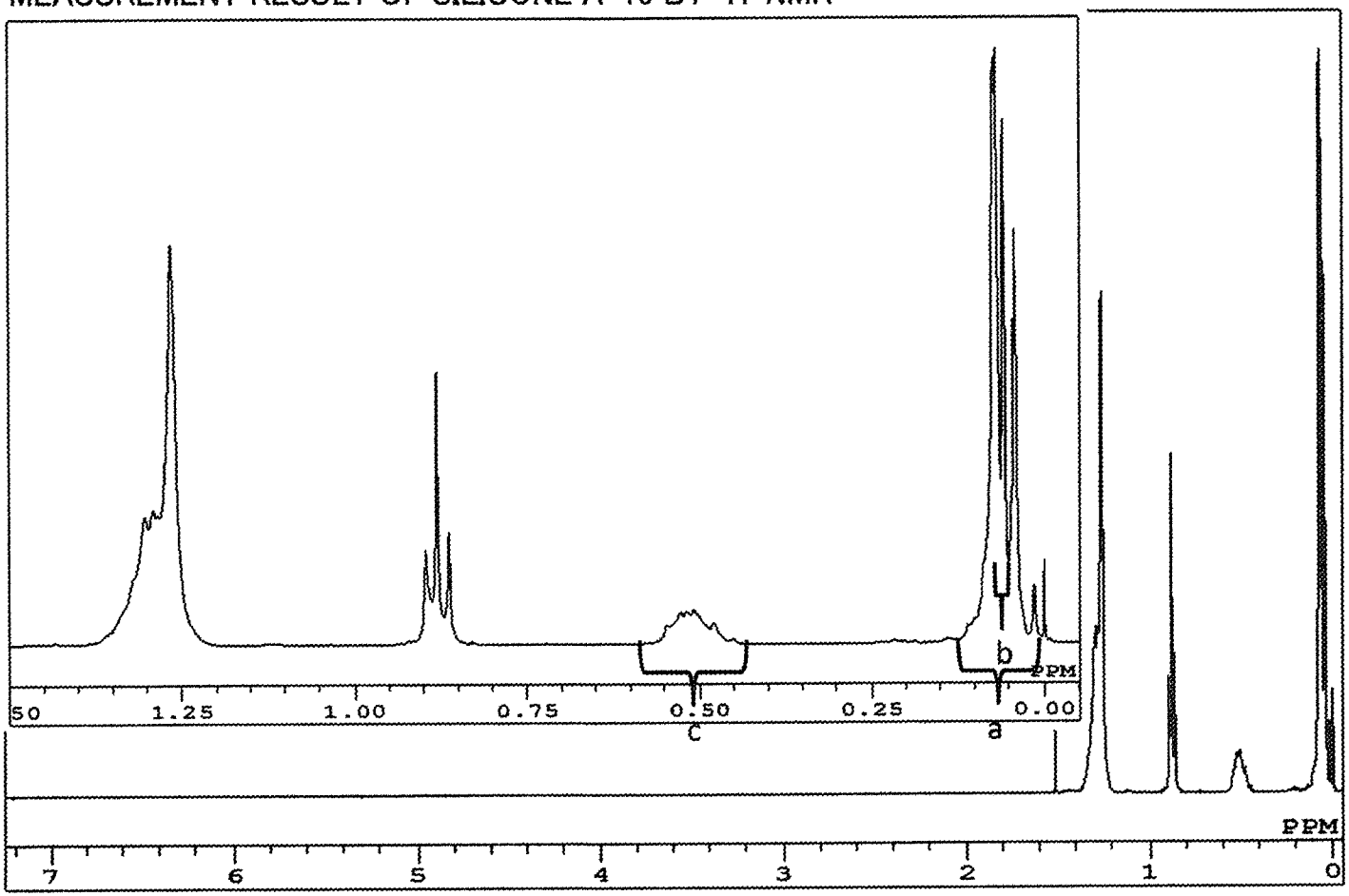
FIG. 15 shows an NMR data of Silicone A-15 synthesized in the embodiment.

The NMR data of Silicone A-15 is shown in FIG. 15.

The $^1$H-NMR analysis on methylalkylpolysiloxane having both molecular chain ends blocked with dimethylalkylsiloxy group shown in A-15 and A-16 was executed in the following manner.

At a (chemical shift: 0.005 to 0.125 ppm) is denoted a peak of hydrogen derived from a methyl group in a dimethyl unit and a unit having an organic group R and a methyl group in dimethylalkylsiloxy group at both molecular chain ends.

At b (chemical shift: 0.05 to 0.06 ppm) is denoted a peak of hydrogen derived from a methyl group in dimethylalkylsiloxy group at both molecular chain ends.

At c (chemical shift: 0.40 to 0.60 ppm) is denoted a peak of hydrogen derived from $CH_2$ adjacent to silicon in an organic group R.

The average molecular weight, the average number of units having an organic group R, and the average number of dimethyl units were calculated by the following equations (4) on the basis of the integrated value (ratio) of the peaks of the a, b, and c.

$$\text{Average number of dimethyl units}=((a-b-1.5\times c))\div 6\times 18\div b$$

$$\text{Average number of units having an organic group R}=(c-b\div 18\times 2)\div 2\times 18\div b$$

$$\text{Average molecular weight}=\text{Average number of units having an organic group R}\times\text{Molecular weight of a unit having an organic group R}+\text{Average number of dimethyl units}\times\text{Molecular weight of a dimethyl unit}+\text{Molecular weight of a dimethylalkylsiloxy group at both molecular chain ends} \quad \text{Equations (4)}$$

$^1$H-NMR (solvent: deuterated chloroform, primary standard substance: TMS)

When the integrated value at δ32 0.40 to 0.60 ppm is 10.0, the integrated value at δ=0.005 to 0.125 ppm is 67.2, and the integrated value at δ=0.05 to 0.06 ppm is 15.0.

(Synthesis Example 16: Silicone A-16)

50 g of Silicone K obtained in Synthesis Example 15 was put in a 500-mililiter four-necked flask, and 97.2 g (i.e., 0.58 mol) of 1-dodecene (Product Name: LINEALENE 12) produced by Idemitsu Kosan Co., Ltd. and 26 μL (converted in Pt: 15 ppm) of Pt-CTS-toluene solution, which is a platinum catalyst, produced by N. E. CHEMCAT Corporation were put on a dropping funnel to undergo a nitrogen substitution. Silicone K was heated, and dropping of the mixture of 1-dodecene and the platinum catalyst was started when the liquid temperature reached 60° C. At this moment, the dropping speed was regulated so as to keep the liquid temperature between 80° C. and 110° C. After all the mixture of 1-dodecene and the platinum catalyst were dropped, the reactants were developed at 90° C. for 4 hours. After having been developed, the disappearance of the peak in SiH groups was confirmed by use of $^1$H-NMR. Subsequently, the resultant was heated and decompressed to remove an excessive amount of 1-dodecene from the reactants. As a result, 91 g of dimethylsiloxane-methyldodecylsiloxane copolymer (Silicone A-16) having both molecular chain ends blocked with dodecyldimethylsiloxy group was obtained.

As a result of analysis on the obtained Silicone A-16 by use of $^1$H-NMR, it was found that: the average molecular weight was 1560; the average number of units ($n_1$) having an organic group $R_1$ (C12) was 3.0; the average number of units ($n_2$) having an organic group $R_1'$ (C1) was 5.5; and the ratio C/Si in the molecular structure was 7.45.

Figure 16:
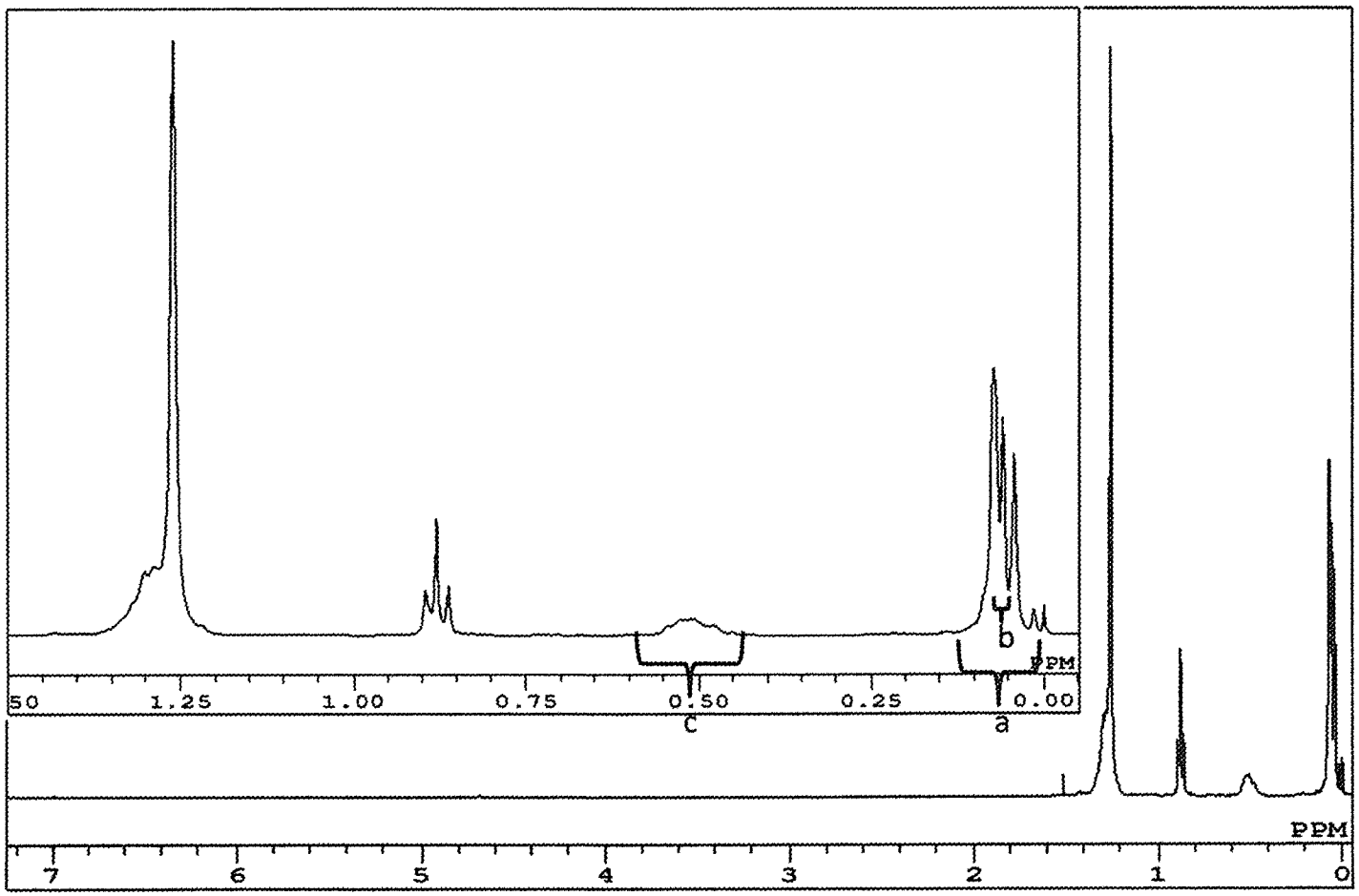
FIG. 16 shows an NMR data of Silicone A-16 synthesized in the embodiment.

The NMR data of Silicone A-16 is shown in FIG. 16.

$^1$H-NMR (solvent: deuterated chloroform, primary standard substance: TMS)

When the integrated value at δ=0.40 to 0.60 ppm is 10.0, the integrated value at δ=0.005 to 0.125 ppm is 68.5, and the integrated value at δ=0.05 to 0.06 ppm is 14.4.

(Synthesis Example 17: Silicone A-17)

40 g of Silicone C obtained in Synthesis Example 3 was put in a 200-mililiter four-necked flask, and 6 g (i.e., 0.05 mol) of α-methylstyrene produced by Mitsui Chemicals, Inc. and 4 μL (converted in Pt: 3 ppm) of Pt-CTS-toluene solution, which is a platinum catalyst, produced by N. E. CHEMCAT Corporation were put on a dropping funnel to undergo a nitrogen substitution. Silicone C was heated, and dropping of the mixture of α-methylstyrene and the platinum catalyst was started when the liquid temperature reached 60° C. At this moment, the dropping speed was regulated so as to keep the liquid temperature between 80° C. and 110° C.

After all the mixture of α-methylstyrene and the platinum catalyst were dropped, the reactants were developed at 100° C. for 2 hours. After having been developed, the appearance of the peak made by a reaction between u-methylstyrene and SiH group and the disappearance of the peak derived from α-methylstyrene were confirmed by use of $^1$H-NMR. Subsequently, 2 g (i.e., 0.02 mol) of 1-hexene (Product Name: LINEALENE 6) produced by Idemitsu Kosan Co., Ltd. and 2 μL (converted in Pt: 2 ppm) of Pt-CTS-toluene solution, which is a platinum catalyst, produced by N. E. CHEMCAT Corporation were put on a dropping funnel. After the reactant of Silicone C with α-methylstyrene was cooled to the temperature of 80° C., dropping of the mixture of 1-hexene and the platinum catalyst was started. At this moment, the dropping speed was regulated so as to keep the liquid temperature between 80° C. and 110° C. After all the mixture of 1-hexene and the platinum catalyst were dropped, the reactants were developed at 90° C. for 2 hours. After having been developed, the disappearance of the peak in SiH groups was confirmed by use of $^1$H-NMR. Subsequently, the resultant was heated and decompressed to remove an excessive amount of 1-hexene from the reactants. As a result, 47 g of dimethylsiloxane-methylhexylsiloxane-methyl 2-phenylpropylsiloxane copolymer (Silicone A-17) having both molecular chain ends blocked with trimethylsiloxy group was obtained.

As a result of analysis on the obtained Silicone A-17 by use of $^1$H-NMR, it was found that: the average molecular weight was 1661; the average number of units ($n_1$) having an organic group $R_1$ (C6) was 3.1; the average number of units ($n_2$) having an organic group $R_1$' (C9) was 1.4; the average number of units ($n_3$) having an organic group $R_1$"(C1) was 10.8; and the ratio C/Si in the molecular structure was 3.67.

Figure 17:
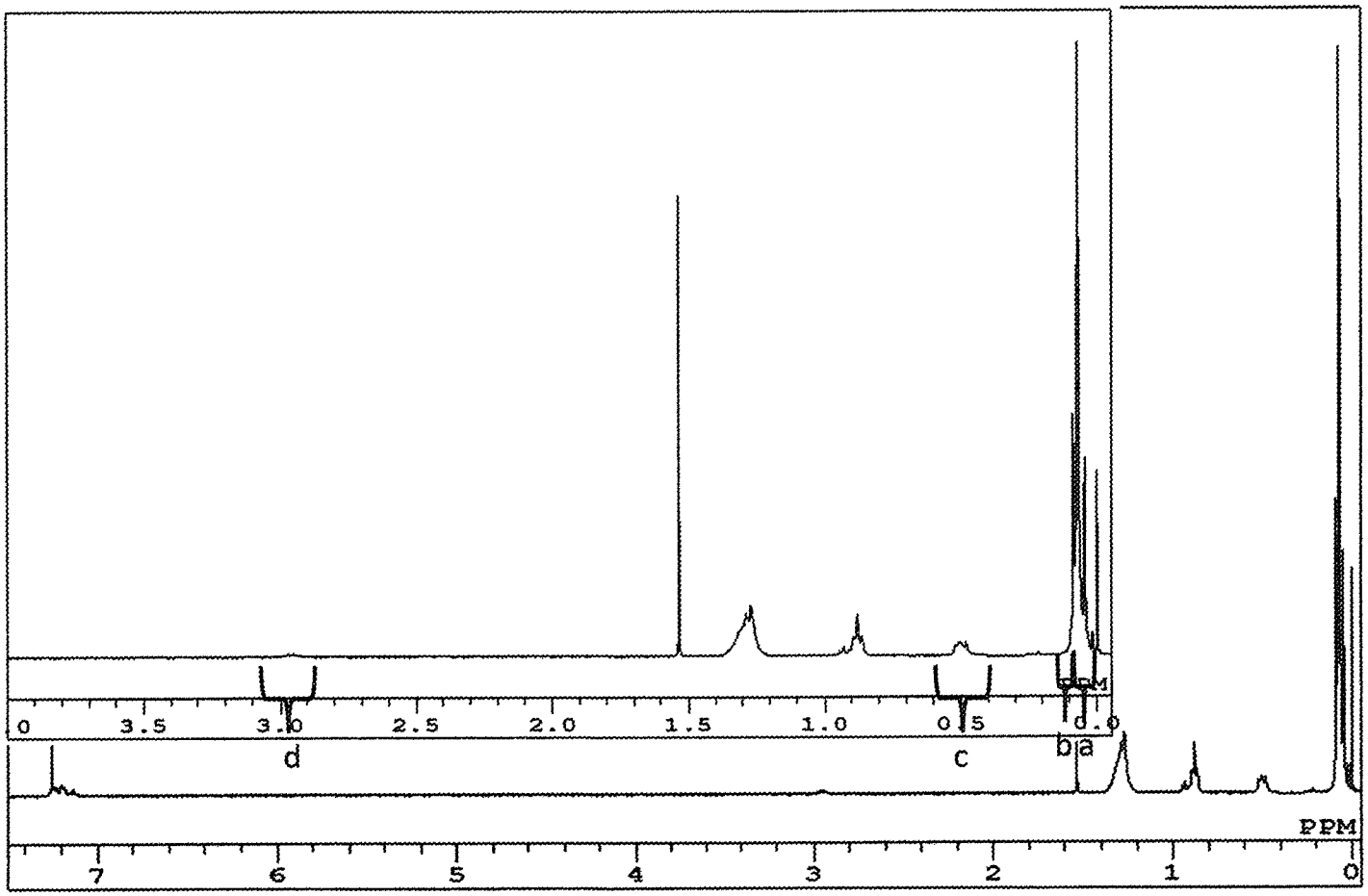
FIG. 17 shows an NMR data of Silicone A-17 synthesized in the embodiment.

The NMR data of Silicone A-17 is shown in FIG. 17.

The $^1$H-NMR analysis on dimethylsiloxane-methylalkylsiloxane-methylaralkylsiloxane copolymer having both molecular chain ends blocked with trimethylsiloxy group shown in A-17 was executed in the following manner.

At a (chemical shift: 0.01 to 0.08 ppm) is denoted a peak of hydrogen derived from a methyl group in a dimethyl unit and a unit having an organic group R.

At b (chemical shift: 0.08 to 0.10 ppm) is denoted a peak of hydrogen derived from a methyl group in trimethylsiloxy group at both molecular chain ends.

At c (chemical shift: 0.40 to 0.60 ppm) is denoted a peak of hydrogen derived from $CH_2$ adjacent to silicon in an organic group R.

At d (chemical shift: 2.85 to 3.05 ppm) is denoted a peak of hydrogen at a benzylic position in an aralkyl group.

The average molecular weight, the average number of units having an organic group R, and the average number of dimethyl units were calculated by the following equations (5) on the basis of the integrated value (ratio) of the peaks of the a, b, c, and d.

Average number of dimethyl units=((a−1.5×c))÷6×18÷b

Average number of units having an organic group R (alkyl group)=c÷2×18÷b

Average number of units having an organic group R (aralkyl group)=d×18÷b

Average molecular weight=Average number of units having an organic group R×Molecular weight of a unit having an organic group R+Average number of dimethyl units×Molecular weight of a dimethyl unit+Molecular weight of a trimethylsiloxy group at both molecular chain ends — Equations (5)

$^1$H-NMR (solvent: deuterated chloroform, primary standard substance: TMS)

When the integrated value at δ=0.40 to 0.60 ppm is 10.0, the integrated value at δ=0.01 to 0.08 ppm is 117.6, the integrated value at δ=0.08 to 0.10 ppm is 28.6, and the integrated value at δ2.85 to 3.05 ppm is 2.2.

As the other silicone oils, the followings were used.

(Silicone A-18)

Silicone A-18 is dimethylpolysiloxane having both molecular chain ends blocked with trimethylsiloxy group (Product Name: KF96L-100CS) produced by Shin-Etsu Chemical Co., Ltd. As a result of analysis on Silicone A-18 by use of $^1$H-NMR, it was found that: the average molecular weight was 2587; the average number of units ($n_1$) having an organic group $R_1$ (C=1) was 32.7; and the ratio C/Si in the molecular structure was 2.09.

Figure 18:
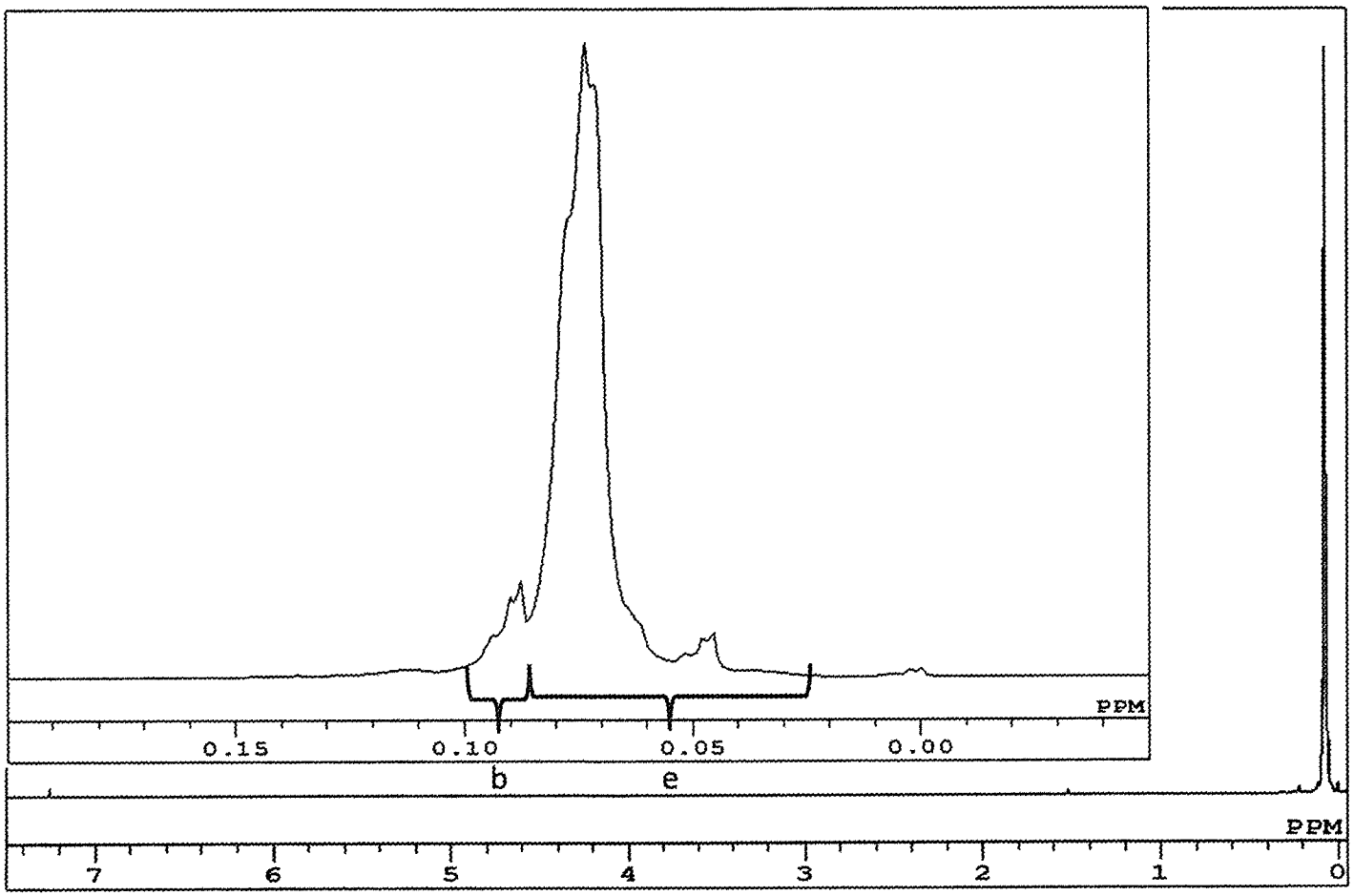
FIG. 18 shows an NMR data of Silicone A-18 synthesized in the embodiment.

The NMR data of Silicone A-18 is shown in FIG. 18.

The $^1$H-NMR analysis on dimethyl silicone was executed in the following manner.

At b (chemical shift: 0.085 to 0.10 ppm) is denoted a peak of hydrogen derived from a methyl group in trimethylsiloxy group at both molecular chain ends.

At e (chemical shift: 0.025 to 0.085 ppm) is denoted a peak of hydrogen derived from a methyl group in a dimethyl unit.

The average molecular weight and the average number of dimethyl units were calculated by the following equation (6) on the basis of the integrated value (ratio) of the peaks of the b and e.

Average molecular weight=Average number of dimethyl units×Molecular weight of a dimethyl unit+Molecular weight of a trimethylsiloxy group at both molecular chain ends — Equation (6)

$^1$H-NMR (solvent: deuterated chloroform, primary standard substance: TMS)

When the integrated value at δ=0.085 to 0.10 ppm is 10.0, the integrated value at δ=0.025 to 0.085 ppm is 109.0.

(Silicone A-19)

Silicone A-19 is dimethylsiloxane-methylphenylsiloxane copolymer having both molecular chain ends blocked with trimethylsiloxy group (Product Name: SH-550) produced by Toray Dow Corning Corporation. As a result of analysis on Silicone A-19 by use of $^{29}$Si-NMR, it was found that: the average molecular weight was 2201; the average number of units ($n_1$) having an organic group $R_1$ (C6) was 10.7; the average number of units ($n_2$) having an organic group $R_1$' (C1) was 7.6; and the ratio C/Si in the molecular structure was 4.73.

Figure 19:
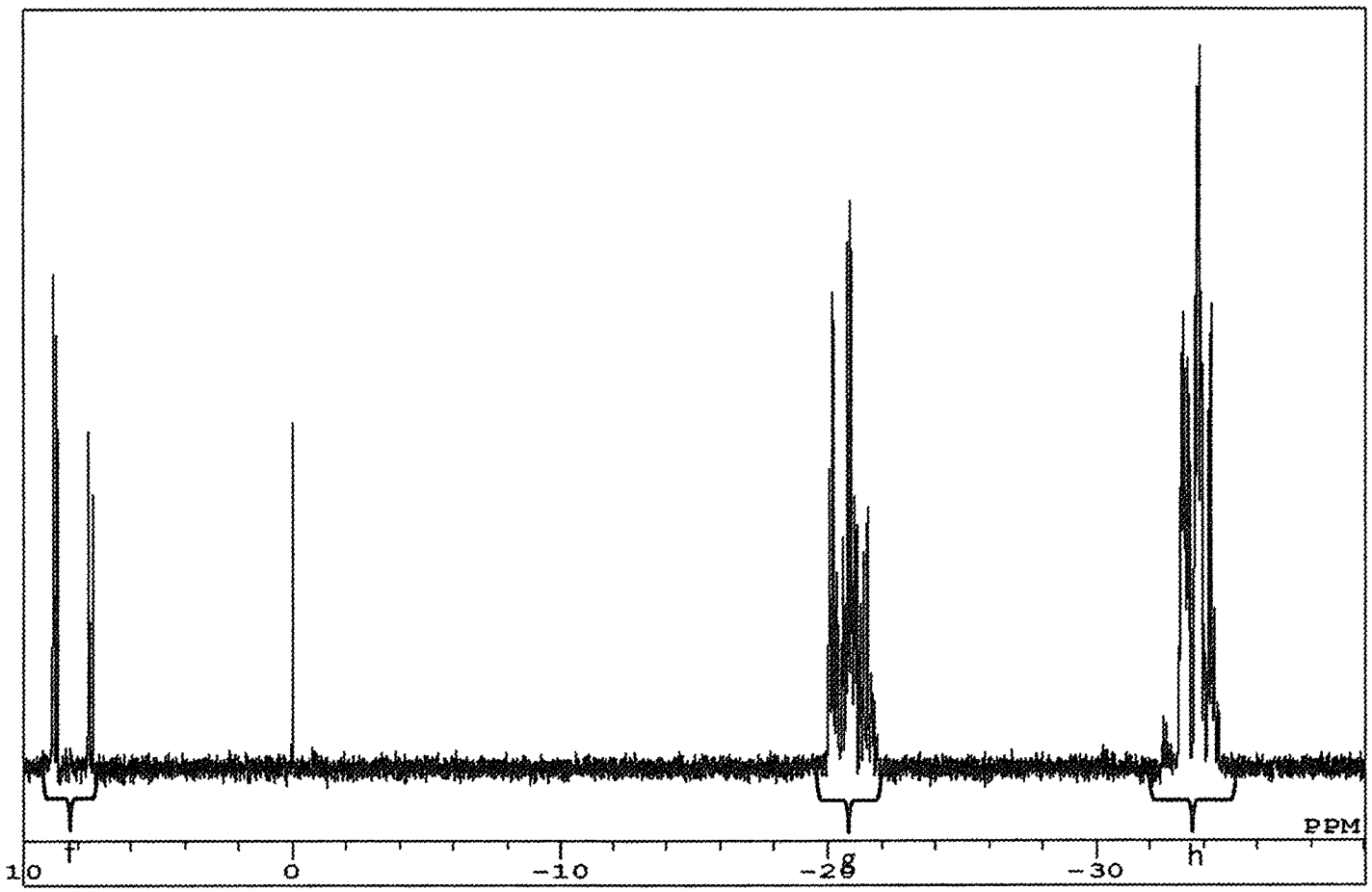
FIG. 19 shows an NMR data of Silicone A-19 synthesized in the embodiment.

The NMR data of Silicone A-19 is shown in FIG. 19.

The $^{29}$Si-NMR analysis on methylphenyl silicone was executed in the following manner.

At f (chemical shift: 7.25 to 9.35 ppm) is denoted a peak of silicon derived from a trimethylsiloxy group at both molecular chain ends.

At g (chemical shift: −19.5 to −22.0 ppm) is denoted a peak of silicon derived from a dimethyl unit.

At h (chemical shift: −32.0 to −35.0 ppm) is denoted a peak of silicon derived from a methylphenyl unit.

The average molecular weight, the average number of dimethyl units, and the average number of methylphenyl units were calculated by the following equation (7) on the basis of the integrated value (ratio) of the peaks of the f, g, and h.

Average molecular weight=Average number of dimethyl units×Molecular weight of a dimethyl unit+Average number of methylphenyl units×Molecular weight of a methylphenyl unit+Molecular weight of a trimethylsiloxy group at both molecular chain ends — Equation (7)

$^{29}$Si-NMR (solvent: deuterated chloroform, primary standard substance: TMS)

When the integrated value at δ=7.25 to 9.35 ppm is 10.0, the integrated value at δ=−19.5 to −22.0 ppm is 38.1, and the integrated value at δ=−32.0 to −35.0 ppm is 53.3.

[Physical Property of Silicone Oil]

The above described Silicones A-1 to A-19 were used in the testings hereinafter. Silicones A-1 to A-16 indicate silicone oils containing an alkyl group. Silicone A-17 is a silicone oil containing an alkyl group and an aralkyl group. Silicone A-18 is a dimethyl silicone, and Silicone A-19 is a methylphenyl silicone.

The viscometric property, the NMR measurement, the flash point, and the low-temperature fluidity were measured and calculated on each silicone oil in accordance with the following procedure. The results are shown in Table 1.

(Viscometric Property)

The kinematic viscosity at 40° C., the kinematic viscosity at 100° C., and the viscosity index (VI) were measured and calculated in accordance with JIS K 2283 (2000).

(NMR Measurement)

The NMR measurement results were used to calculate the average molecular weight, and to calculate a number of carbons of alkyl groups and the ratio C/Si. $^{1}$H-NMR and $^{29}$Si-NMR were measured using a 400 MHz FT NMR spectrometer of JNM-ECX series produced by JEOL Ltd.

(Flash Point Measurement)

A Cleaveland Open Cup Flash Point Tester ("Automated Flash Point Tester aco-8" produced by Tanaka Scientific Limited) was used to measure flash points. In the case of evaluation of a lubricant composition, the measurement does not stop automatically because the vapor of silicone oil deposits on the detector. Therefore, the ignition was confirmed by sight, and the temperature at which the lubricant composition ignited was defined as the flash point.

(Low-Temperature Fluidity)

With respect to the low-temperature fluidity, a rheometer ("ARES-RDA W/FCO" produced by TA Instruments-Waters LLC) was used to evaluate the fluidity and the absolute viscosity at −40° C.

TABLE 1

| | average molecular weight | organic group $R_1$ | average number of units $n_1$ (unit) | Organic group $R_1'$ | average number of units $n_2$ (unit) | Organic group $R_1''$ | average number of units $n_3$ (unit) | Organic group $R_1$ |
|---|---|---|---|---|---|---|---|---|
| Silicone A-1 | 1377 | 6 | 2.8 | 1 | 10.9 | 0 | 0.0 | 1.0 |
| Silicone A-2 | 1361 | 6 | 2.9 | 1 | 10.6 | 0 | 0.0 | 1.0 |
| Silicone A-3 | 1469 | 6 | 4.2 | 1 | 9.4 | 0 | 0.0 | 1.0 |
| Silicone A-4 | 1741 | 8 | 4.7 | 1 | 10.3 | 0 | 0.0 | 1.0 |
| Silicone A-5 | 2454 | 8 | 6.9 | 1 | 14.9 | 0 | 0.0 | 1.0 |
| Silicone A-6 | 3868 | 8 | 11.1 | 1 | 24.1 | 0 | 0.0 | 1.0 |
| Silicone A-7 | 850 | 6 | 3.3 | 1 | 2.9 | 0 | 0.0 | 1.0 |
| Silicone A-8 | 890 | 6 | 3.9 | 1 | 2.2 | 0 | 0.0 | 1.0 |
| Silicone A-9 | 1654 | 10 | 4.1 | 1 | 9.0 | 0 | 0.0 | 1.0 |
| Silicone A-10 | 1728 | 12 | 3.9 | 1 | 9.0 | 0 | 0.0 | 1.0 |
| Silicone A-11 | 2046 | 14 | 4.5 | 1 | 9.9 | 0 | 0.0 | 1.0 |
| Silicone A-12 | 1292 | 6 | 7.8 | 0 | 0.0 | 0 | 0.0 | 1.0 |
| Silicone A-13 | 2613 | 6 | 17.0 | 0 | 0.0 | 0 | 0.0 | 1.0 |
| Silicone A-14 | 3982 | 6 | 26.5 | 0 | 0.0 | 0 | 0.0 | 1.0 |
| Silicone A-15 | 1346 | 8 | 3.2 | 1 | 5.9 | 0 | 0.0 | 8.0 |
| Silicone A-16 | 1560 | 12 | 3.0 | 1 | 5.5 | 0 | 0.0 | 12.0 |
| Silicone A-17 | 1661 | 6 | 3.1 | 9 | 1.4 | 1 | 10.8 | 1.0 |
| Silicone A-18 | 2587 | 1 | 32.7 | 0 | 0.0 | 0 | 0.0 | 1.0 |
| Silicone A-19 | 2201 | 6 | 10.7 | 1 | 7.6 | 0 | 0.0 | 1.0 |

| | C/Si ratio | kinematic viscosity at 40° C. ($mm^2/s$) | kinematic viscosity at 100° C. ($mm^2/s$) | Viscosity Index VI | Flash point (° C.) | Low-Temperature fluidity |
|---|---|---|---|---|---|---|
| Silicone A-1 | 3.03 | 18.3 | 7.3 | 429 | 200 or higher | −40° C. or lower |
| Silicone A-2 | 3.05 | 15.6 | 6.3 | 432 | 200 or higher | −40° C. or lower |
| Silicone A-3 | 3.47 | 20.4 | 7.8 | 404 | 250 or higher | −40° C. or lower |
| Silicone A-4 | 4.05 | 23.8 | 8.1 | 353 | 250 or higher | −40° C. or lower |
| Silicone A-5 | 4.10 | 74.3 | 24.7 | 357 | 250 or higher | −40° C. or lower |
| Silicone A-6 | 4.14 | 124.8 | 41.2 | 360 | 250 or higher | −40° C. or lower |
| Silicone A-7 | 4.25 | 8.0 | 3.1 | 326 | 192 | −40° C. or lower |
| Silicone A-8 | 4.64 | 8.4 | 3.2 | 307 | 204 | −40° C. or lower |

TABLE 1-continued

| | | | | | | |
|---|---|---|---|---|---|---|
| Silicone A-9 | 4.60 | 29.3 | 9.6 | 340 | 250 or higher | −40° C. or lower |
| Silicone A-10 | 5.03 | 39.9 | 12.1 | 315 | 250 or higher | −29° C. |
| Silicone A-11 | 5.67 | 45.0 | 13.0 | 302 | 250 or higher | −9° C. |
| Silicone A-12 | 6.19 | 19.2 | 6.0 | 300 | 240 | −40° C. or lower |
| Silicone A-13 | 6.58 | 82.7 | 23.6 | 313 | 250 or higher | −40° C. or lower |
| Silicone A-14 | 6.72 | 202.7 | 55.1 | 324 | 250 or higher | −40° C. or lower |
| Silicone A-15 | 5.44 | 11.9 | 4.3 | 331 | 200 or higher | −40° C. or lower |
| Silicone A-16 | 7.45 | 21.3 | 6.4 | 286 | 250 or higher | −29° C. |
| Silicone A-17 | 3.67 | 29.3 | 10.4 | 373 | 250 or higher | −40° C. or lower |
| Silicone A-18 | 2.09 | 73.0 | 31.2 | 431 | 200 or higher | −40° C. or lower |
| Silicone A-19 | 4.73 | 75.3 | 20.1 | 291 | 200 or higher | −40° C. or lower |

(Observations)

From the results of Table 1, it was found that the smaller the carbon number of R in the formula (1) is, and the smaller the average molecular weight is, the higher the VI tends to be. Further, it was found that the larger the carbon number of the R is, the poorer the low-temperature fluidity is.

It was found from Silicones A-7 and A-8 that when the average molecular weight is lower than around 900, the flash point is below 200° C. Besides, it was found from Silicone A-14 that when the average molecular weight is around 4000, the kinematic viscosity at 40° C. is substantially 200 $mm^2/s$.

From the above, it could be confirmed that a silicone oil with the carbon number of R in the formula (1) of 12 or smaller and having an average molecular weight of 900 to 4000 may be used for the object of providing a lubricant composition that can be used in a wide temperature range, and is excellent in the energy saving performance.

[Compatibility Between Silicone Oil and Hydrocarbon-Based Lubricant]

Next, an ester oil, an ether oil, a poly-α-olefin (PAO), and a mineral oil were weighed so as to respectively have a mass ratio of 1:1 to the silicone oil, and were respectively stirred and mixed at a room temperature (25° C.) to confirm the compatibility. The mixed fluid immediately after the stir was observed by sight, and the presence or absence of turbidity was evaluated (the presence of turbidity was evaluated as "Poor", and the absence of turbidity was evaluated as "Good").

The results of the evaluation of the compatibility is shown in Table 2.

TABLE 2

| | Reference Examples | | | | | | | | | | | | |
|---|---|---|---|---|---|---|---|---|---|---|---|---|---|
| | 1 | 2 | 3 | 4 | 5 | 6 | 7 | 8 | 9 | 10 | 11 | 12 | 13 |
| Silicone A-1 | 50.0 | 50.0 | 50.0 | 50.0 | | | | | | | | | |
| Silicone A-2 | | | | | 50.0 | 50.0 | 50.0 | 50.0 | | | | | |
| Silicone A-5 | | | | | | | | | 50.0 | 50.0 | 50.0 | 50.0 | |
| Silicone A-13 | | | | | | | | | | | | | 50.0 |
| Silicone A-18 | | | | | | | | | | | | | |
| Silicone A-19 | | | | | | | | | | | | | |
| Ester oil B-1 | 50.0 | | | | 50.0 | | | | 50.0 | | | | 50.0 |
| Ether oil B-4 | | 50.0 | | | | 50.0 | | | | 50.0 | | | |
| PAO oil B-5 | | | 50.0 | | | | 50.0 | | | | 50.0 | | |
| Mineral oil B-6 | | | | 50.0 | | | | 50.0 | | | | 50.0 | |
| Presence/ Absence or Turbidity | G* | P*[2] | G | G | G | G | G | G | G | G | G | G | G |

TABLE 2-continued

| | Reference Examples | | | | | | | | | | |
|---|---|---|---|---|---|---|---|---|---|---|---|
| | 14 | 15 | 16 | 17 | 18 | 19 | 20 | 21 | 22 | 23 | 24 |
| Silicone A-1 | | | | | | | | | | | |
| Silicone A-2 | | | | | | | | | | | |
| Silicone A-5 | | | | | | | | | | | |
| Silicone A-13 | 50.0 | 50.0 | 50.0 | | | | | | | | |
| Silicone A-18 | | | | 50.0 | 50.0 | 50.0 | 50.0 | | | | |
| Silicone A-19 | | | | | | | | 50.0 | 50.0 | 50.0 | 50.0 |
| Ester oil B-1 | | | | 50.0 | | | | 50.0 | | | |
| Ether oil B-4 | 50.0 | | | | 50.0 | | | | 50.0 | | |
| PAO oil B-5 | | 50.0 | | | | 50.0 | | | | 50.0 | |
| Mineral oil B-6 | | | 50.0 | | | | 50.0 | | | | 50.0 |
| Presence/ Absence or Turbidity | G | G | G | P | P | P | P | G | G | P | G |

*Good,
*2Poor.

(Observations)

From Reference Examples 1 to 4, it was found that when the ratio C/Si in a silicone oil is 3.03, the silicone oil is compatible with hydrocarbon-based lubricants other than the ether oil. It could be confirmed that the silicone oils having a C/Si ratio of 3.05 or higher in Testing Cases 5 to 16 are respectively compatible with an ester oil, an ether oil, a poly-α-olefin, and a mineral oil.

Further, Reference Examples 17 to 20 show results of evaluation of the dimethyl silicone having a C/Si ratio of 2.09. It was found that the silicone could not be solved in any of the lubricant base oils.

Further, Reference Examples 21 to 24 are results of evaluation of the methylphenyl silicone having a C/Si ratio of 4.73. In the case of the methylphenyl silicone, it was found that the silicone, even with a high C/Si ratio, could not be solved in poly-α-olefin.

These results clearly showed that: when having the C/S ratio in the structure of 3.03 or higher, a silicone oil used for the lubricant composition according to the present invention is compatible with a lubricant base oil not including an aromatic group in the structure; and when having the C/S ratio of 3.05 or higher, the silicone oil is compatible with a compound having a structure including an aromatic group such as alkyl diphenyl ether.

Accordingly, it can be said that a silicone oil having a good compatibility requires to have a C/Si ratio in the structure of 3.03 or higher, and further preferably a C/Si ratio of 3.05 or higher.

[Testing Case 1: Evaluation of Lubricity]

The lubricant compositions of Examples 1 to 21 and Comparative Examples 1 to 5 were prepared by adding respective components so as to have a ratio (mass %) shown in the below Table 3, heating (A) silicone oil, (B) hydrocarbon-based oil, (C) antioxidant, and the other additives to 100° C. and mixing them.

The viscosity index (VI), the compatibility, and the lubricity were evaluated on the obtained lubricant compositions of each Example and each Comparative Example in the following testing methods.

(Viscosity Index (VI))

It was evaluated in the same manner as that was used for the above-described silicone oil. As evaluation criteria, those which had lower than 200 were evaluated as Poor, those which had 200 to 250 were evaluated as "Good", and those which had 250 or higher were evaluated as "Excellent".

(Compatibility)

It was evaluated in the same manner as that was used for the above-described silicone oil. As evaluation criteria, those without the turbidity were evaluated as "Good", those with the turbidity were evaluated as "Poor".

(Lubricity)

The lubricity was evaluated according to a high-speed four-ball test. Specifically, a Falex Lubricity Tester (#6) was used for evaluation. The evaluation was performed on worn scar diameters under the testing condition of: rotational speed: 1200 rpm; the temperature of the lubricant composition: 75° C.; load: 392 N; and test time: 60 min. As evaluation criteria by worn scar diameters, those which had 2000 μm or longer were evaluated as Poor, those which had 1500 to 2000 μm were evaluated as "Good", and those which had 800 to 1500 μm were evaluated as "Excellent"; and those which had less than 800 μm were evaluated as "Excellent+".

The results are shown in Table 3.

TABLE 3

| | Examples | | | | | | | | | | | | | |
|---|---|---|---|---|---|---|---|---|---|---|---|---|---|---|
| | 1 | 2 | 3 | 4 | 5 | 6 | 7 | 8 | 9 | 10 | 11 | 12 | 13 | 14 |
| Silicone A-3 | | | | | | | | 50.0 | | | | | | |
| Silicone A-4 | 80.0 | 75.0 | 70.0 | 65.0 | 60.0 | 55.0 | 50.0 | | | | | 70.0 | 70.0 | 70.0 |
| Silicone A-5 | | | | | | | | | | | 70.0 | | | |
| Silicone A-12 | | | | | | | | | | 75.0 | | | | |
| Silicone A-14 | | | | | | | | | 70.0 | | | | | |
| Silicone A-18 | | | | | | | | | | | | | | |
| Silicone A-19 | | | | | | | | | | | | | | |
| Ester oil B-1 | | | | | | | | | | | 22.0 | 25.0 | | |
| Ester oil B-2 | 15.0 | 20.0 | 25.0 | 30.0 | 35.0 | 40.0 | 45.0 | 45.0 | 25.0 | 20.0 | | | 25.0 | |
| Ester oil B-3 | | | | | | | | | | | | | | 25.0 |
| Ether oil B-7 | | | | | | | | | | | | | | |
| PAO oil B-8 | | | | | | | | | | | | | | |
| Anti-oxidant C-1 | 5.0 | 5.0 | 5.0 | 5.0 | 5.0 | 5.0 | 5.0 | 5.0 | 5.0 | 5.0 | 5.0 | 5.0 | 5.0 | 5.0 |
| Anti-oxidant C-4 | | | | | | | | | | | 3.0 | | | |
| MD*1 | | | | | | | | | | | | | | |
| VI | 312 | 294 | 282 | 273 | 262 | 251 | 235 | 251 | 277 | 334 | 290 | 282 | 270 | 290 |
| WSD*5 (μm) | E*3 1483 | E 1051 | E 1004 | E 1249 | E 1309 | E 1096 | G*4 944 | E 956 | E 1040 | E 1060 | E 630 | E 1004 | E 1112 | E 1123 |
| P/A*8 of Turbidity | E G | E G | E G | E G | E G | E G | E G | E G | E G | E G | E+*6 G | E G | E G | E G |

| | Examples | | | | | | | Comparative Examples | | | | |
|---|---|---|---|---|---|---|---|---|---|---|---|---|
| | 15 | 16 | 17 | 18 | 19 | 20 | 21 | 1 | 2 | 3 | 4 | 5 |
| Silicone A-3 | | | | | | | | | | | | |
| Silicone A-4 | 70.0 | 70.0 | 75.0 | 55.0 | 70.0 | 75.0 | 70.0 | 95.0 | 85.0 | | | |
| Silicone A-5 | | | | | | | | | | | | |
| Silicone A-12 | | | | | | | | | | | | |
| Silicone A-14 | | | | | | | | | | | | |
| Silicone A-18 | | | | | | | | | | 95.0 | 70.0 | |
| Silicone A-19 | | | | | | | | | | | | 70.0 |
| Ester oil B-1 | 15.0 | 15.0 | 10.0 | 15.0 | | | | | | | | |
| Ester oil B-2 | 10.0 | | | | 20.0 | | 25.0 | | 10.0 | | 25.0 | 25.0 |
| Ester oil B-3 | | 10.0 | | | | | | | | | | |
| Ether oil B-7 | | | 10.0 | | 5.0 | 20.0 | | | | | | |
| PAO oil B-8 | | | | 26.5 | | | | | | | | |
| Anti-oxidant C-1 | 5.0 | 5.0 | 5.0 | 3.0 | 5.0 | 5.0 | 4.5 | 5.0 | 5.0 | 5.0 | 5.0 | 5.0 |
| Anti-oxidant C-4 | | | | | | | | | | | | |
| MD*1 | | | | 0.5 | | | 0.5 | | | | | |
| VI | 276 E | 283 E | 267 E | 258 E | 284 E | 259 E | 268 E | 358 E | 309 E | 279 E | 230 G | NE*2 |

TABLE 3-continued

| | | | | | | | | | | | | |
|---|---|---|---|---|---|---|---|---|---|---|---|---|
| WSD*5 (μm) | 1110 | 1111 | 1190 | 1096 | 1382 | 1851 | 1204 | 3558 | 3827 | 3922 | 4241 | NE |
| | E | E | E | E | E | G | E | P*7 | P | P | P | |
| P/A*8 of Turbidity | G | G | G | G | G | G | G | G | G | G | G | P |

*1Metal Deactivator,
*2Not Evaluable,
*3Excellent,
*4Good,
*5Worn Scar Diameter,
*6Excellent+,
*7Poor,
*8Presence/Abesence of Turbidity (Good or Poor).

(Observations)

From Examples 1 to 21, it was found that a lubricant composition having a high viscosity index could be prepared when containing a silicone oil, hydrocarbon-based lubricant, and antioxidant in an additional amount defined in the present invention. Further, the results of Examples 1 to 8 and 10 showed that a lubricant composition having a higher viscosity index could be obtained if the viscosity index (VI) of the silicone oil is higher even when the additional amount of the silicone oil is small.

Further, from Examples 17 to 20, it was found that a lubricant composition having a better lubricity (with a worn scar diameter of 1500 μm or smaller) could be prepared when containing 10 mass % or more of ester oil as hydrocarbon-based lubricant. Further, from Example 21 it was confirmed that the lubricant composition is not affected by an addition of other additives.

On the other hand, Comparative Examples 1 to 2 showed that when the amount of the silicone oil is excessive (85 mass % or higher), the worn scar diameter exceeds 3000 μm, and the composition could not be used as lubricant.

Besides, Comparative Examples 3 to 4 show the case in which a methylphenyl silicone (Silicone A-18) was used as silicone oil. The worn scar diameter exceeded 3000 μm even when containing the same content as in the present invention, and it was found that the composition could not be used as lubricant.

Comparative Example 5 shows the case in which a dimethyl silicone (Silicone A-19) was used as silicone oil. There was a turbidity at the stage of preparation, and a lubricant composition could not be prepared well. Accordingly, it was not possible to evaluate the viscosity and the lubricity.

[Testing Case 2: Evaluation of Lubricity 2]

The lubricant compositions of Examples 22 to 36 and Examples 53 to 56 were prepared in the same manner as in Example 1 described above, other than that each component was added so as to have a ratio (mass %) shown in the below Table 4. Further, in the present testing case the lubricant composition of Example 11 obtained above was used as well. Thereafter, the viscosity index (VI) and the lubricity were evaluated in the same manner as in Testing Case 1. The results are shown in Table 4.

TABLE 4

| | Examples | | | | | | | | | | |
|---|---|---|---|---|---|---|---|---|---|---|---|
| | 22 | 23 | 24 | 25 | 26 | 27 | 28 | 29 | 30 | 11 | 31 |
| Silicone A-4 | 70.0 | 70.0 | 70.0 | 70.0 | 70.0 | 70.0 | 70.0 | 70.0 | 70.0 | | 70.0 |
| Silicone A-5 | | | | | | | | | | 70.0 | |
| Ester oil B-1 | | | | | | | | | | 22.0 | |
| Ester oil B-2 | 29.0 | 25.0 | 27.0 | 25.0 | 23.0 | 20.0 | 25.0 | 25.0 | 25.0 | | 22.0 |
| Ether oil B-7 | | | | | | | | | | | |
| PAO oil B-5 | | | | | | | | | | | |
| Antioxidant C-1 | | 2.5 | | | | | | | | 5.0 | 3.0 |
| Antioxidant C-4 | 1.0 | .5 | 3.0 | 5.0 | 7.0 | 10.0 | | | | 3.0 | 5.0 |
| Antioxidant C-5 | | | | | | | 5.0 | | | | |
| Antioxidant C-6 | | | | | | | | 5.0 | | | |
| Antioxidant C-7 | | | | | | | | | 5.0 | | |
| Antioxidant C-8 | | | | | | | | | | | |
| Metal Deactivator | | | | | | | | | | | |
| VI | 264 | 299 | 283 | 301 | 307 | 307 | 300 | 299 | 296 | 290 | 307 |
| | E*1 | E | E | E | E | E | E | E | E | E | E |

TABLE 4-continued

| | | | | | | | | | | | |
|---|---|---|---|---|---|---|---|---|---|---|---|
| Worn Scar diameter (μm) | 948 E | 626 *2E+ | 620 E+ | 571 E+ | 563 E+ | 722 E+ | 589 E+ | 688 E+ | 907 E | 630 E+ | 578 E+ |
| | | | Examples | | | | | | | | |
| | | | 32 | 33 | 34 | 35 | 36 | 53 | 54 | 55 | 56 |
| | | Silicone A-4 | 70.0 | 70.0 | 70.0 | 70.0 | 70.0 | 70.0 | 70.0 | 70.0 | 70.0 |
| | | Silicone A-5 | | | | | | | | | |
| | | Ester oil B-1 | | | | | | | | | |
| | | Ester oil B-2 | 20.0 | 22.0 | 20.0 | | | | | | 11.8 |
| | | Ether oil B-7 | | | | 25.0 | | 21.5 | | 11.8 | |
| | | PAO oil B-5 | | | | | 25.0 | | 23.5 | 11.8 | 11.8 |
| | | Antioxidant C-1 | 5.0 | 1.0 | 5.0 | | | 1.5 | 1.5 | 1.5 | 1.5 |
| | | Antioxidant C-4 | 5.0 | 7.0 | 3.0 | 5.0 | 5.0 | | | | |
| | | Antioxidant C-5 | | | | | | | | | |
| | | Antioxidant C-6 | | | | | | | | | |
| | | Antioxidant C-7 | | | 2.0 | | | 5.0 | 3.0 | 3.0 | 3.0 |
| | | Antioxidant C-8 | | | | | | 1.5 | 1.5 | 1.5 | 1.5 |
| | | Metal Deactivator | | | | | | 0.5 | 0.5 | 0.5 | 0.5 |
| | | VI | 310 E | 303 E | 307 E | 279 E | 284 E | 278 E | 278 E | 277 E | 285 E |
| | | Worn Scar diameter (μm) | 580 E+ | 568 E+ | 746 E+ | 1184 E | 829.5 E | 920 E | 760 E+ | 873 E | 828 E |

*1Excellent,
*2Excellent+

(Observations)

In the present testing, the viscometric property and the lubricity were evaluated by changing the types and the additional amounts of antioxidant. Consequently, it was shown that a further excellent lubricity could be obtained by using phosphite as antioxidant. An effect of abrasion resistance was proven starting with 1.0 to 10.0 mass % of phosphite, and the effect of improving the lubricity was found to be significant with 2.5 to 7.0 mass % thereof.

[Testing Case 3: Evaluation of Low-Temperature Fluidity]

The lubricant compositions of Examples 37 to 42, 53, 54 and Comparative Example 6 were prepared in the same manner as in Example 1 described above, other than that each component was added so as to have a ratio (mass %) shown in the below Table 5. Further, in the present testing case, the lubricant compositions of Examples 3, 7, and 11 obtained above were used as well. The viscosity index (VI) was evaluated in the same manner as in the above by using the lubricant compositions of each of these Examples and Comparative Example. Further, the low-temperature fluidity and the solidifying temperature were evaluated in the manner described below.

(Low-Temperature Fluidity)

With respect to the low-temperature fluidity, the rheometer ("ARES-RDA W/FCO" produced by TA Instruments-Waters LLC) was used to evaluate the fluidity at −30° C. and −40° C., and the absolute viscosity at −40° C. Further, the fluidity and the presence or absence of separation were confirmed after that the lubricant compositions had been kept to stand in an atmosphere at −40° C. for one week. As evaluation criteria of the low-temperature fluidity, those which had the viscosity at −40° C. of lower than 5 Pa·s were evaluated as Excellent, those which had 5 to 30 Pa·s were evaluated as Good, those which had 30 Pa·s or higher but did not solidify were evaluated as "Fair", and those which solidified were evaluated as "Poor".

(Solidifying Temperature)

The viscosity during the process of lowering the temperature from the room temperature was continuously measured, and a temperature at which the measurement of the viscosity became impossible after a sudden increase in viscosity was defined as the solidifying temperature. As evaluation criteria of the solidifying temperature, those which had the solidifying temperature of −40° C. or lower and did not solidify were evaluated as Good, and those which solidified at −40° C. or lower were evaluated as Poor.

The results of the foregoing are shown in Table 5.

TABLE 5

| | Examples | | | | | |
|---|---|---|---|---|---|---|
| | 37 | 3 | 38 | 39 | 40 | 42 |
| Silicone A-3 | 70.0 | | | | | |
| Silicone A-4 | | 70.0 | | | | |
| Silicone A-5 | | | | | | |
| Silicone A-9 | | | 70.0 | | | |
| Silicone A-10 | | | | 70.0 | | |
| Silicone A-11 | | | | | | |
| Silicone A-15 | | | | | 70.0 | |
| Silicone A-16 | | | | | | |
| Silicone A-17 | | | | | | 70.0 |
| Ester oil B-1 | | | | | | |
| Ester oil B-2 | 25.0 | 25.0 | 25.0 | 25.0 | 25.0 | 25.0 |
| Ester oil B-7 | | | | | | |
| PAO oil B-5 | | | | | | |
| Antioxidant C-1 | 5.0 | 5.0 | 5.0 | 5.0 | 5.0 | 5.0 |
| Antioxidant C-4 | | | | | | |
| Antioxidant C-7 | | | | | | |
| Antioxidant C-8 | | | | | | |
| Metal Deactivator | | | | | | |
| VI | 296 | 282 | 263 | 263 | 242 | 285 |
| | Excellent | Excellent | Excellent | Excellent | Good | Excellent |
| viscosity at −40° C. (Pa · s) | 1.2 | 1.5 | 3.2 | 24.0 | 0.6 | 6.1 |
| | Excellent | Excellent | Excellent | Good | Good | Good |
| Fluidity at −30° C. | Fluid | Fluid | Fluid | Fluid | Fluid | Fluid |
| | Good | Good | Good | Good | Good | Good |
| Fluidity at −40° C. | Fluid | Fluid | Fluid | Fluid | Fluid | Fluid |
| | Good | Good | Good | Good | Good | Good |
| Fluidity after having | Fluid | Fluid | Solidified | Solidified | Fluid | Fluid |
| been kept to stand at | Good | Good | Poor | Poor | Good | Good |
| −40° C. | | | | | | |
| Solidifying | Not | Not | Not | −47° C. | Not | Not |
| temperature | solidified | solidified | solidified | | solidified | solidified |
| | at −60° C. | at −60° C. | at −60° C. | | at −60° C. | at −60° C. |
| | Good | Good | Good | Good | Good | Good |

| | Examples | | | | Comparative Example | Comparative Example |
|---|---|---|---|---|---|---|
| | 11 | 7 | 53 | 54 | 41 | 6 |
| Silicone A-3 | | | | | | |
| Silicone A-4 | | 50.0 | 70.0 | 70.0 | | |
| Silicone A-5 | 70.0 | | | | | |
| Silicone A-9 | | | | | | |
| Silicone A-10 | | | | | | |
| Silicone A-11 | | | | | | 70.0 |
| Silicone A-15 | | | | | | |
| Silicone A-16 | | | | | 70.0 | |
| Silicone A-17 | | | | | | |
| Ester oil B-1 | 22.0 | | | | | |
| Ester oil B-2 | | 45.0 | | | 25.0 | 25.0 |
| Ester oil B-7 | | | 21.5 | | | |
| PAO oil B-5 | | | | 23.5 | | |
| Antioxidant C-1 | 5.0 | 5.0 | 1.5 | 1.5 | 5.0 | 5.0 |
| Antioxidant C-4 | | | | | | |
| Antioxidant C-7 | 3.0 | | 5.0 | 3.0 | | |
| Antioxidant C-8 | | | 1.5 | 1.5 | | |
| Metal Deactivator | | | 0.5 | 0.5 | | |
| VI | 290 | 235 | 278 | | 226 | 273 |
| | Excellent | Good | Excellent | | Good | Excellent |
| viscosity at −40° C. (Pa · s) | 4.7 | 1.3 | 1.2 | | Solidified | Solidified |
| | Excellent | Excellent | Excellent | | Poor | Poor |
| Fluidity at −30° C. | Fluid | Fluid | Fluid | | Fluid | Solidified |
| | Good | Good | Good | | Good | Poor |
| Fluidity at −40° C. | Fluid | Fluid | Fluid | | Solidified | Solidified |
| | Good | Good | Good | | Poor | Poor |
| Fluidity after having | Fluid | Fluid | Fluid | | Solidified | Solidified |
| been kept to stand at | Good | Good | Good | | Poor | Poor |
| −40° C. | | | | | | |
| Solidifying | Not | −53° C. | Not | | −32° C. | −14° C. |
| temperature | solidified | | solidified | | | |
| | at −60° C. | | at −60° C. | | | |
| | Good | Good | Good | | Poor | Poor |

(Observations)

Since a silicone oil containing $R_1$ in formula (1) having 6 to 12 carbons was used in Examples 3, 7, 11, 37 to 40, 42, 53 and 54, and Comparative Example 41, the compositions did not solidify even at −30° C. Since Example 39 with 12 carbons had relatively high viscosity at −40° C., and Comparative Example 41 lost fluidity at −40° C., it was shown that the one with the alkyl having less than 12 carbons is further preferable. Besides, the compositions of Examples 38 and 39 and Comparative Example 41 containing an alkyl group with 10 and 12 carbons, solidified when being kept to stand in a low-temperature atmosphere. Thus, it was found that the carbon number of the alkyl is particularly preferably less than 10. It was found that Example 42, which is a mixture of an alkyl chain C6 and an aralkyl group C9, does not solidify at −40° C., but its viscosity exceeds 5.0 Pa·s. When an aralkyl group is used, even with the carbon number being less than 10, increases the viscosity at −40° C. Thus, it was shown that an alkyl group is preferable to an aralkyl group.

On the other hand, since a composition shown in Comparative Example 6 containing the alkyl with 14 carbons solidified before having reached −30° C., it was found that the composition could not be used at a low temperature.

[Testing Case 4: Evaluation of Evaporativity and Duration of Lubricant]

The lubricant compositions of Examples 43 to 52 and Comparative Example 7 were prepared in the same manner as in Example 1 described above other than that each component was added so as to have a ratio (mass %) shown in below Table 6. Further, in the present testing case, the lubricant compositions of Examples 3, 11, and 23 obtained above were used as well. The viscosity index (VI) was evaluated in the same manner as in the above by using the lubricant compositions of each of these Examples and Comparative Example. Further, the evaporation property and the duration of the lubricant were evaluated in the manner described below.

(Evaporation Property and Duration of Lubricant)

The evaporativity of the lubricant compositions was evaluated based on the amount (%) reduced by evaporation after the elapse of 50 hours since 2.0 g of the lubricant compositions of each Examples and Comparative Example and 2.0 g of iron powder were put in a 10 mL beaker, and were heated at 180° C. As the evaluation criteria of the evaporativity, those which lost less than 15% were evaluated as Excellent, those which lost 15 to 20% were evaluated as Good, and those which lost more than 20% were evaluated as Fair, and those which solidified were evaluated as Poor.

Further, the duration of the lubricant was evaluated based on the time until the solidification. As the evaluation criteria of the duration of the lubricant, those which did not solidify for 80 hours or more were evaluated as Excellent, those which solidified in 40 to 80 hours were evaluated as Good, those which solidified in less than 40 hours were evaluated as Poor.

The results of the foregoing are shown in Table 6.

TABLE 6

| | Examples | | | | | | | |
|---|---|---|---|---|---|---|---|---|
| | 43 | 44 | 3 | 45 | 46 | 47 | 48 | 49 |
| Silicone A-4 | 70.0 | 70.0 | 70.0 | 70.0 | 70.0 | 70.0 | 70.0 | 70.0 |
| Silicone A-5 | | | | | | | | |
| Ester oil B-1 | | | | | | | | |
| Ester oil B-2 | 29.0 | 27.0 | 25.0 | 23.0 | 20.0 | 25.0 | 25.0 | 25.0 |
| Antioxidant C-1 | 1.0 | 3.0 | 5.0 | 7.0 | 10.0 | | | 2.5 |
| Antioxidant C-2 | | | | | | 5.0 | | 2.5 |
| Antioxidant C-3 | | | | | | | 5.0 | |
| Antioxidant C-4 | | | | | | | | |
| VI | 301 | 290 | 282 | 284 | 271 | 294 | 303 | 290 |
| | Excellent | Excellent | Excellent | Excellent | Excellent | Excellent | Excellent | Excellent |
| Evaporating amount at 180° C. after 40 h (%) | 8 | 10 | 11 | 13 | 15 | 15 | 11 | 10 |
| | Excellent | Excellent | Excellent | Excellent | Excellent | Excellent | Excellent | Excellent |
| Duration of lubricant | Good | Excellent | Excellent | Excellent | Excellent | Good | Excellent | Good |

| | Examples | | | | | Comparative Example |
|---|---|---|---|---|---|---|
| | 23 | 50 | 51 | 52 | 11 | 7 |
| Silicone A-4 | 70.0 | 70.0 | 70.0 | 70.0 | | 70.0 |
| Silicone A-5 | | | | | 70.0 | |
| Ester oil B-1 | | | | | 22.0 | |
| Ester oil | 25.0 | 25.0 | 25.0 | 25.0 | | 30.0 |

TABLE 6-continued

| | | | | | | |
|---|---|---|---|---|---|---|
| B-2 | | | | | | |
| Antioxidant C-1 | 2.5 | | 2.5 | | 5.0 | |
| Antioxidant C-2 | | 2.5 | | 2.5 | | |
| Antioxidant C-3 | | | 2.5 | 2.5 | | |
| Antioxidant C-4 | 2.5 | 2.5 | | | 3.0 | |
| VI | 299 | 299 | 304 | 297 | 290 | 306 |
| | Excellent | Excellent | Excellent | Excellent | Excellent | Excellent |
| Evaporating amount at 180° C. after 40 h (%) | 11 | 17 | 9 | 11 | 9 | solidified |
| | Excellent | Good | Excellent | Excellent | Excellent | Poor |
| Duration of lubricant | Excellent | Good | Excellent | Good | Excellent | Poor |

(Observations)

As a result of having compared the evaporating amount after 50 hours, when compared based on the presence or absence of antioxidant, Comparative Example 7 without an antioxidant solidified within 50 hours. On the other hand, none of the lubricant compositions of Examples containing antioxidant solidified even after 50 hours. The more the content of the antioxidant was, the more the evaporating amount was.

[Testing Case 5: Evaluation of Shear Stability]

The lubricant compositions of Comparative Examples 8 to 9 were prepared in the same manner as in Example 1 described above, other than that each component was added so as to have a ratio (mass %) shown in the below Table 7. Further, in the present testing case, the lubricant compositions of Examples 3 and 11 obtained above were used as well. The viscosity index (VI), the lubricity, the evaporativity, the duration of the lubricant, and the turbidity were evaluated in the same manner as in the above by using the lubricant compositions of each of these Examples and Comparative Examples. Further, the shear stability was evaluated in the manner described below.

(Shear Stability)

Ultrasonic waves were irradiated to the lubricant compositions of each of the Examples and Comparative Examples for 60 minutes in accordance with JASO M347-95. Then, the kinematic viscosity at 40° C. and the kinematic viscosity at 100° C. were measured on each of the lubricant compositions before and after ultrasonic irradiation in accordance with JIS K 2283 (2000). The kinematic viscosity before ultrasonic irradiation was defined as v0, and the kinematic viscosity after ultrasonic irradiation was defined as v1. The rate of decrease ((v0−v1)/v0×100) was calculated based on the measured kinematic viscosities. The shear stability was evaluated based on the rate of change between the kinematic viscosity at 40° C. and the kinematic viscosity at 100° C. according to the following criteria.

Evaluation criteria of Shear Stability: those which had the rate of change of less than 5% were evaluated as Excellent, those which had the rate of change of 5 to 10% were evaluated as Good, and those which had the rate of change of 10% or more were evaluated as Poor.

The results of the foregoing are shown in Table 7.

TABLE 7

| | Examples | | Comparative Examples | |
|---|---|---|---|---|
| | 3 | 11 | 8 | 9 |
| Silicone A-4 | 70.0 | | | |
| Silicone A-5 | | 70.0 | | |
| Ester oil B-1 | | 22.0 | | |
| Ester oil B-2 | 25.0 | | 85.0 | 70.0 |
| Antioxidant C-1 | 5.0 | 5.0 | 5.0 | 5.0 |
| Antioxidant C-4 | | 3.0 | | |
| Extreme pressure agent | | | 5.0 | 5.0 |
| Viscosity Index improver | | | 5.0 | 20.0 |
| VI | 282 | 290 | 195 | 240 |
| | Excellent | Excellent | Poor | Good |
| Worn scar diameter (μm) | 1004 | 630 | 612 | 655 |
| | Excellent | Excellent+ | Excellent+ | Excellent+ |
| Kinematic viscosity at 40° C. before ultrasonic irradiation ($mm^2/s$) | 23.8 | 53.3 | 43.1 | 185.2 |
| Kinematic viscosity at 40° C. after ultrasonic irradiation ($mm^2/s$) | 23.8 | 53.6 | 27.6 | 61.8 |
| Rate of change in viscosity (%) | −0.3 | −0.5 | 35.9 | 66.7 |
| | Excellent | Excellent | Poor | Poor |
| Kinematic viscosity at 100° C. before ultrasonic irradiation ($mm^2/s$) | 7.0 | 14.7 | 9.0 | 35.4 |
| Kinematic viscosity at 100° C. after ultrasonic irradiation ($mm^2/s$) | 7.0 | 14.7 | 5.7 | 11.7 |
| Rate of change in viscosity (%) | −0.3 | −0.1 | 36.4 | 66.9 |
| | Excellent | Excellent | Poor | Poor |

TABLE 7-continued

| | Examples | | Comparative Examples | |
|---|---|---|---|---|
| | 3 | 11 | 8 | 9 |
| Solidifying temperature | Not solidified at −60° C. Good | Not solidified at −60° C. Good | Not solidified at −60° C. Good | Not solidified at −60° C. Good |
| Evaporating amount (%) at 180° C. after 40 h | 11 Excellent | 9 Excellent | 13 Excellent | 20 Fair |
| Duration of lubricant | Excellent | Excellent | Excellent | Excellent |
| Presence/Absence of Turbidity | Absent Good | Absent Good | Absent Good | Absent Good |

(Observations)

Here, the lubricant compositions of the present invention and the ester oils including a viscosity index improver were compared.

It was found that the lubricant compositions of Examples 3 and 11 of the present invention are not affected by a shear other than having the properties described above. Namely, it could be confirmed that the lubricant compositions of the present invention are excellent in the shear stability as well.

On the other hand, the ester oil of Comparative Examples 8 and 9 including a viscosity index improver resulted in being inferior in the shear stability. Besides, it was found that when the content of the viscosity index improver is small, the sample enhances fewer effect of improving the viscosity index, and as the additional amount of the viscosity index improver increases, the sample is more affected by a shear.

This application is based on Japanese Patent Application No. 2018-77830 filed on Apr. 13, 2018, the contents of which are incorporated in the present application.

While the present invention has been fully and appropriately described in the above by way of embodiments by referring to the specific examples and the like in order to express the present invention, it is to be recognized that those skilled in the art can readily change and/or modify the embodiments described above. Therefore, it is to be construed that the changes or modifications made by those skilled in the art are encompassed within the scope of the claims unless those changes or modifications are at a level that departs from the scope of the claims described in the claims section of the present application.

INDUSTRIAL APPLICABILITY

Since the lubricant composition of the present invention has a high thermostability, shear stability together with an excellent low-temperature fluidity, and can be used as lubricant in a wide temperature range, the lubricant composition can be preferably used as lubricant for usual bearing, lubricant for impregnated bearing, a grease base oil, a freezer oil, a plasticizer, and the like.

The invention claimed is:

1. A lubricant composition comprising, at least:

(A) 50 to 80 mass % of silicone oil represented by a formula (1) below, and having a mass-average molecular weight of 900 to 4000, a ratio (C/Si ratio) of carbon to silicon of 3.03 or higher in the structure, and a viscosity index (VI) of 300 or higher;

(B) 10 to 45 mass % of hydrocarbon-based lubricant; and (C) 1 to 10 mass % of antioxidant,

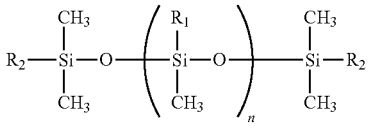

(1)

wherein $R_1$ and $R_2$ represent an alkyl group or an aralkyl group with 1 to 12 carbons, when $R_1$ or $R_2$ exceeds 1 carbon, then the other is 8 carbons or less, and n represents an integer between 9 and 36.

2. The lubricant composition according to claim 1, which comprises 10 to 45 mass % of ester oil as the (B) hydrocarbon-based lubricant to the total amount of the composition.

3. The lubricant composition according to claim 1, which comprises 1 to 10 mass % of phosphite as the (C) antioxidant to the total amount of the composition.

4. The lubricant composition according to claim 1, which has an absolute viscosity of 5.0 Pa·s or lower at −40° C.

5. The lubricant composition according to claim 1, wherein the viscosity index (VI) is 250 or higher.

6. A lubricating agent comprising the lubricant composition according to claim 1.

7. A grease comprising the lubricant composition according to claim 1.

8. An emulsion comprising the lubricant composition according to claim 1.

9. A method of lubricating, comprising lubricating a surface with the lubricant composition according to claim 1.

10. The method of claim 9, wherein the surface is a bearing.

11. A grease comprising the lubricating agent according to claim 6.

12. An emulsion comprising the lubricating agent according to claim 6.

13. The lubricant composition according to claim 1, which comprises 55 to 80 mass % of the (A) silicone oil to the total amount of the composition.

14. The lubricant composition according to claim 1, which comprises 60 to 80 mass % of the (A) silicone oil to the total amount of the composition.

15. The lubricant composition according to claim 1, wherein in formula (1), $R_1$ represents an alkyl group or an aralkyl group with 1 to 12 carbons, and $R_2$ represents an alkyl group or an aralkyl group with 1 to 8 carbons.

16. The lubricant composition according to claim 1, wherein in formula (1), $R_1$ and $R_2$ represent an alkyl group or an aralkyl group with 1 to 8 carbons.

17. The lubricant composition according to claim 1, which comprises 15 to 45 mass % of the (B) hydrocarbon-based lubricant to the total amount of the composition.

18. The lubricant composition according to claim 1, wherein the (A) silicone oil has a kinematic viscosity at 40° C. of 200 $mm^2/s$ or less.

* * * * *